US009599933B2

(12) United States Patent
Aruga

(10) Patent No.: US 9,599,933 B2
(45) Date of Patent: Mar. 21, 2017

(54) IMAGE FORMING APPARATUS AND TONER CONTAINER ATTACHABLE TO AND DETACHABLE FROM IMAGE FORMING APPARATUS

(71) Applicant: CANON KABUSHIKI KAISHA, Tokyo (JP)

(72) Inventor: Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/655,911

(22) PCT Filed: Dec. 20, 2013

(86) PCT No.: PCT/JP2013/084337

§ 371 (c)(1),
(2) Date: Jun. 26, 2015

(87) PCT Pub. No.: WO2014/103958

PCT Pub. Date: Jul. 3, 2014

(65) Prior Publication Data

US 2015/0346641 A1 Dec. 3, 2015

(30) Foreign Application Priority Data

Dec. 27, 2012 (JP) ..... 2012-285799

(51) Int. Cl.
*G03G 21/16* (2006.01)
*G03G 15/095* (2006.01)
(Continued)

(52) U.S. Cl.
CPC ..... *G03G 15/095* (2013.01); *B41J 2/473* (2013.01); *G03G 15/04* (2013.01); *G03G 21/16* (2013.01);
(Continued)

(58) Field of Classification Search
CPC ..... G03G 21/16
(Continued)

(56) References Cited

U.S. PATENT DOCUMENTS 8,089,500 B2 1/2012 Matsuo et al.
2014/0184719 A1* 7/2014 Aruga ..... G03G 15/0409 347/243
(Continued)

FOREIGN PATENT DOCUMENTS

JP H07-146633 A 6/1995
JP H08-248862 A 9/1996
(Continued)

OTHER PUBLICATIONS

International Search Report, PCT/JP2013/084337, pp. 1-2, Jan. 2006.*
(Continued)

*Primary Examiner* — Clayton E Laballe
*Assistant Examiner* — Kevin Butler
(74) *Attorney, Agent, or Firm* — Canon U.S.A. Inc., IP Division

(57) ABSTRACT

In the structure of a shutter moving mechanism, if the inclination angle of an elongated hole with respect to a sliding direction of a shutter is increased, it is necessary to increase the size of a movement plate for moving the shutter. On the other hand, if the inclination angle of the elongated hole with respect to the sliding direction of the shutter is decreased, an urging force with which a user urges the door against an image forming apparatus when shutting the door is increased. A shutter moving mechanism includes a rotation mechanism and moves the shutter by rotation of the rotation mechanism.

18 Claims, 14 Drawing Sheets

(51) Int. Cl.

| | |
|---|---|
| ***G03G 15/04*** | (2006.01) |
| ***B41J 2/47*** | (2006.01) |
| *G03G 21/18* | (2006.01) |

(52) U.S. Cl.
CPC . *G03G 21/1853* (2013.01); *G03G 2215/0119* (2013.01); *G03G 2221/1654* (2013.01); *G03G 2221/1684* (2013.01)

(58) Field of Classification Search
USPC ..... 399/110
See application file for complete search history.

(56) References Cited

U.S. PATENT DOCUMENTS

| | | | | |
|---|---|---|---|---|
| 2015/0241839 | A1* | 8/2015 | Iwai | G03G 21/1666 347/118 |
| 2015/0346641 | A1* | 12/2015 | Aruga | G03G 15/04 399/110 |

FOREIGN PATENT DOCUMENTS

| | | | | |
|---|---|---|---|---|
| JP | H11-272142 | A | 10/1999 | |
| JP | 2006-119462 | * | 5/2006 | G03G 21/18 |
| JP | 2006-119462 | A | 5/2006 | |
| JP | 2006-184307 | A | 7/2006 | |
| JP | 2007-148276 | * | 6/2007 | G02B 26/10 |
| JP | 2007-148276 | A | 6/2007 | |
| JP | 2009-075609 | A | 4/2009 | |
| JP | 2011-198483 | A | 10/2011 | |
| JP | 2012-003046 | A | 1/2012 | |
| JP | 2012-234200 | A | 11/2012 | |

OTHER PUBLICATIONS

PCT Written Opinion of the International Searching Authority, PCT/JP2013/084337, pp. 1-5, Dec. 20, 2013.*

Canon Kabushiki Kaisha, International Search Report, PCT/JP2013/084337, Jan. 2006.*

Canon Kabushiki Kaisha, Written Opinion of the International Searching Authority PCT/JP2013/084337, Mar. 18, 2014.*

* cited by examiner (a)

(b)

(c)

(a)

(b)

(a)

(b)

(a)

(b)

(a)

(b)

(a)

(b)

(a)

(b)

IMAGE FORMING APPARATUS AND TONER CONTAINER ATTACHABLE TO AND DETACHABLE FROM IMAGE FORMING APPARATUS

TECHNICAL FIELD

The present invention relates to an image forming apparatus including an optical scanning device having a transparent window through which a laser beam passes and a mechanism for moving a shutter that covers the transparent window through which the laser beam passes. The present invention also relates to a toner container that is attachable to and detachable from an image forming apparatus including an optical scanning device having a transparent window through which a laser beam passes and a mechanism for moving a shutter that covers the transparent window through which the laser beam passes.

BACKGROUND ART

Optical scanning devices that are included in electrophotographic image forming apparatuses each have a transparent window through which a laser beam that has been deflected by a polygon mirror passes to the outside of the optical scanning device. Dust adhering to the transparent window may block the laser beam and may reduce the quality of an output image. In particular, in a case where the optical scanning device is of a type that exposes a photoconductor member to light from below the photoconductor member in the direction of gravity, when detaching a cartridge, in which a developing device and the photoconductor member are integrated with each other, from the image forming apparatus, toner may fall from the developing device due to vibration and may adhere to the transparent window.

In order to solve such a problem, PTL 1 discloses an image forming apparatus that detects movement of an attachment/detachment member, such as a maintenance door, by using a sensor and that includes a shutter moving mechanism for sliding a shutter, which covers a transparent window, by using a motor in accordance with the movement of the attachment/detachment member.

CITATION LIST

Patent Literature

PTL 1: Japanese Patent Laid-Open No. 2007-148276

SUMMARY OF INVENTION

Technical Problem

However, with the structure of the shutter moving mechanism described in PTL 1, if the sensor or the motor malfunctions, it may become impossible to open and close the shutter and to perform an image forming operation.

Solution to Problem

In order to solve the above problem, an image forming apparatus according to the present invention is an image forming apparatus including a photoconductor member and a developing device that develops an electrostatic latent image, which is formed on the plurality of photoconductor member, by using toner; an optical scanning device including a transparent window through which a light beam scanning the photoconductor member to form the electrostatic latent image on the photoconductor member passes; a shutter that is disposed between the photoconductor member and the optical scanning device and that moves between a first position at which the shutter is withdrawn from an optical path of the light beam that has passed through the transparent window and a second position at which the shutter covers the transparent window; a transfer device that transfers the toner image on the photoconductor member to a transfer member; a cleaning device that recovers residual toner that remains on the photoconductor member instead of being transferred to the transfer member; a toner container holding unit that holds a toner container for storing the residual toner recovered by the cleaning device, the toner container being attachable to and detachable from a body of the image forming apparatus; and a shutter moving mechanism including a first movement portion that contacts the toner container and that moves around a rotation shaft as a rotation axis and a second movement portion that moves around the rotation shaft, wherein, when the toner container is attached to the toner container holding unit, the first movement portion contacts the toner container before the toner container is held by the toner container holding unit, the first movement portion and the second movement portion move around the rotation shaft as the rotation axis in a first direction in accordance with movement of the toner container, and thereby the shutter moving mechanism moves the shutter from the second position to the first position.

An image forming apparatus according to the present invention is an image forming apparatus including a photoconductor member and a developing device that develops an electrostatic latent image, which is formed on the plurality of photoconductor member, by using toner; an optical scanning device including a transparent window through which a light beam scanning the photoconductor member to form the electrostatic latent image on the photoconductor member passes; a shutter that is disposed between the photoconductor member and the optical scanning device and that moves between a first position at which the shutter is withdrawn from an optical path of the light beam that has passed through the transparent window and a second position at which the shutter covers the transparent window; an intermediate transfer member to which a toner image on the photoconductor member is transferred and a transfer device that transfers the toner image on the intermediate transfer member to a recording medium; a cleaning device that recovers residual toner that remains on the intermediate transfer member instead of being transferred to the recording medium; a toner container holding unit that holds a toner container for storing the residual toner recovered by the cleaning device, the toner container being attachable to and detachable from a body of the image forming apparatus; and a shutter moving mechanism including a first movement portion that moves around a rotation shaft as a rotation axis and a second movement portion that contacts the shutter and that moves around the rotation shaft, wherein, when the toner container is attached to the toner container holding unit, the first movement portion contacts the toner container before the toner container is held by the toner container holding unit, the first movement portion and the second movement portion move around the rotation shaft as the rotation axis in a first direction in accordance with movement of the toner container, and thereby the shutter moving mechanism moves the shutter from the second position to the first position.

An image forming apparatus according to the present invention includes a photoconductor member and a developing device that develops an electrostatic latent image, which is formed on the plurality of photoconductor member, by using toner; an optical scanning device including a transparent window through which a light beam scanning the photoconductor member to form the electrostatic latent image on the photoconductor member passes; a shutter that is disposed between the photoconductor member and the optical scanning device and that moves between a first position at which the shutter is withdrawn from an optical path of the light beam that has passed through the transparent window and a second position at which the shutter covers the transparent window; a transfer device that transfers the toner image on the photoconductor member to a transfer member; and a shutter moving mechanism including a maintenance door that is opened or closed when performing maintenance of the developing device, and a first movement portion that moves around a rotation shaft as a rotation axis, a second movement portion that contacts the shutter and that moves around the rotation shaft as the rotation axis, wherein, when a state of the door is changed from an open state to a closed state, the first movement portion contacts the door before the door is completely closed, the first movement portion and the second movement portion move around the rotation shaft as the rotation axis in the first direction in accordance with movement of the door when the state of the door is changed from the open state to the closed state, and thereby the shutter moving mechanism moves the shutter from the second position to the first position.

Moreover, an image forming apparatus according to the present invention includes a photoconductor member and a developing device that develops an electrostatic latent image, which is formed on the plurality of photoconductor member, by using toner; an optical scanning device including a transparent window through which a light beam scanning the photoconductor member to form the electrostatic latent image on the photoconductor member passes; a shutter that is disposed between the photoconductor member and the optical scanning device and that moves between a first position at which the shutter is withdrawn from an optical path of the light beam that has passed through the transparent window and a second position at which the shutter covers the transparent window; an intermediate transfer member to which a toner image on the photoconductor member is transferred and a transfer device that transfers the toner image on the intermediate transfer member to a recording medium; and a shutter moving mechanism including a maintenance door that is opened or closed when performing maintenance of the developing device, and a first movement portion that moves around a rotation shaft as a rotation axis, a second movement portion that contacts the shutter and that moves around the rotation shaft as the rotation axis, wherein, when a state of the door is changed from an open state to a closed state, the first movement portion contacts the door before the door is completely closed, the first movement portion and the second movement portion move around the rotation shaft as the rotation axis in the first direction in accordance with movement of the door when the state of the door is changed from the open state to the closed state, and thereby the shutter moving mechanism moves the shutter from the second position to the first position.

Advantageous Effects of Invention

The shutter can be moved with a simple structure, because the shutter moving mechanism contacts the toner container and the shutter moving mechanism in contact with the toner container moves the shutter due to movement of the toner container.

DESCRIPTION OF EMBODIMENTS

First Embodiment

Image Forming Apparatus

Figure 1:
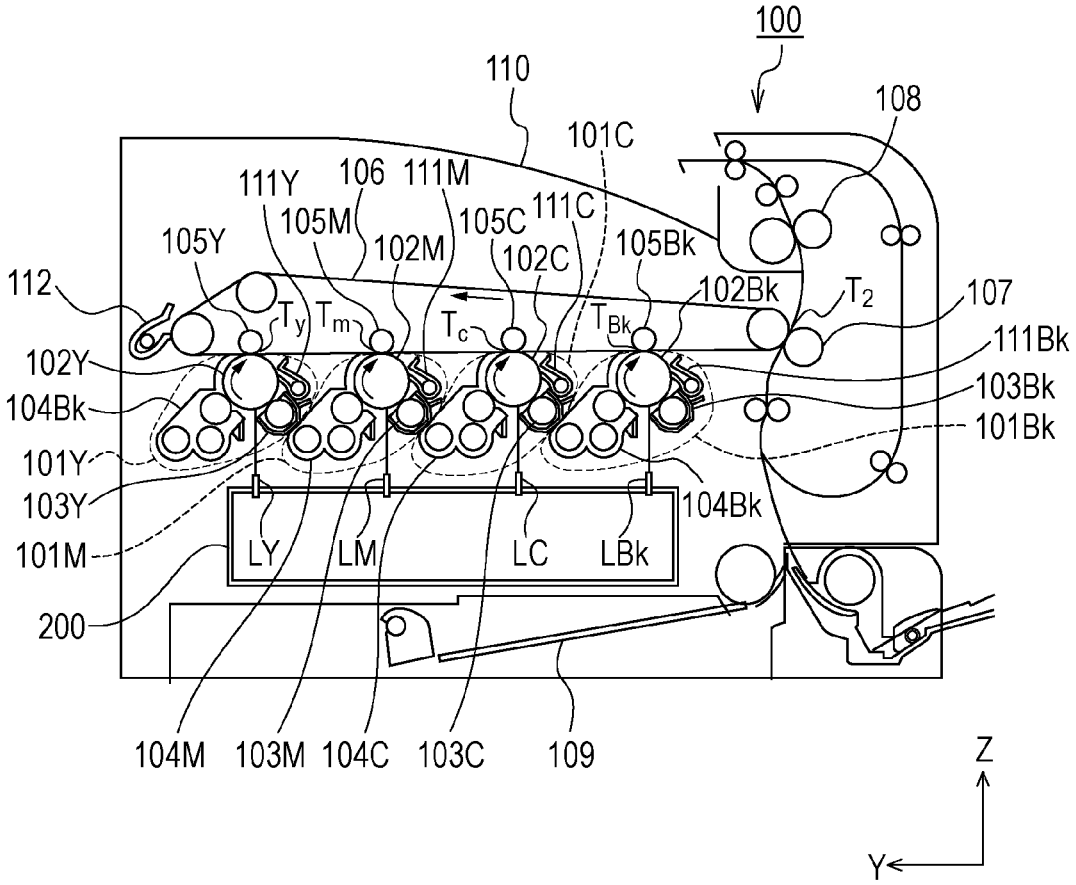
FIG. 1 illustrates a schematic sectional view of an image forming apparatus.

FIG. 1 is a schematic sectional view of an electrophotographic image forming apparatus 100. The image forming apparatus 100 illustrated in FIG. 1 includes four image forming units 101Y, 101M, 101C, and 101BK, which respectively form yellow, magenta, cyan, and black toner images. The image forming units 101Y, 101M, 101C, and 101BK respectively include photoconductor drums 102Y, 102M, 102C, and 102BK, each of which is a photoconductor member. The image forming units respectively include chargers 103Y, 103M, 103C, and 103BK for charging the photoconductor drums 102Y, 102M, 102C, and 102BK; and developing devices 104Y, 104M, 104C, and 104BK for developing electrostatic latent images on the photoconductor drums by using toner. Moreover, the image forming units include cleaning devices 111Y, 111M, 111C, and 111BK for removing residual toner on the photoconductor drums from the photoconductor drums.

Each of the image forming units is structured as a process cartridge in which the photoconductor drum, the charger, the developing device, and the cleaning device are integrated with each other. The process cartridge is a replacement unit that is attachable to and detachable from the image forming apparatus. Hereinafter, the image forming units 101Y, 101M, 101C, and 101BK will be respectively referred to as process cartridges 101Y, 101M, 101C, and 101BK.

An optical scanning device 200; transfer rollers 105Y, 105M, 105C, and 105BK; an intermediate transfer belt 106; a cleaning device 112; a sheet feeder 109; a sheet output tray 110; a transfer roller 107; and a fixing unit 108 are disposed in a body of the image forming apparatus 100. The optical scanning device 200 is disposed below the photoconductor drums in the direction of gravity. Alternatively, the optical scanning device may be disposed so as to expose the photoconductor drums to light from above the photoconductor drums in the direction of gravity.

Next, an image formation process will be described. The optical scanning device 200 emits light beams LY, LM, LC, and LBK (laser beams), to which the photoconductor drums 102Y, 102M, 102C, and 102BK, which have been charged by the chargers 103Y, 103M, 103C, and 103BK, are respectively exposed. Due to exposure to the light beams, electrostatic latent images are formed on the photoconductor drums 102Y, 102M, 102C, and 102BK.

The developing device 104Y develops an electrostatic latent image formed on the photoconductor drum 102Y by using a yellow toner. The developing device 104M develops an electrostatic latent image formed on the photoconductor drum 102M by using a magenta toner. The developing device 104C develops an electrostatic latent image formed on the photoconductor drum 102C by using a cyan toner. The developing device 104BK develops an electrostatic latent image formed on the photoconductor drum 102BK by using a black toner.

A yellow toner image formed on the photoconductor drum 102Y is transferred to the intermediate transfer belt 106, which is an intermediate transfer member, in a transfer region Ty by the transfer roller 105Y. The cleaning device 111Y recovers residual toner at a position between the transfer region Ty and a charging unit of the charger 103Y in a direction in which the photoconductor drum 102Y rotates. The residual toner is toner that is not transferred to the intermediate transfer belt 106 but remains on the photoconductor drum 102Y.

A magenta toner image formed on the photoconductor drum 102M is transferred to the intermediate transfer belt 106 in a transfer region Tm by the transfer roller 105M. The cleaning device 111M recovers residual toner at a position between the transfer region Tm and a charging unit of the charger 103M in the direction in which the photoconductor drum 102M rotates. The residual toner is toner that is not transferred to the intermediate transfer belt 106 but remains on the photoconductor drum 102M.

A cyan toner image formed on the photoconductor drum 102C is transferred to the intermediate transfer belt 106 in a transfer region Tc by the transfer roller 105C. The cleaning device 111C recovers residual toner at a position between the transfer region Tc and a charging unit of the charger 103C in the direction in which the photoconductor drum 102C rotates. The residual toner is toner that is not transferred to the intermediate transfer belt 106 but remains on the photoconductor drum 102C.

A black toner image formed on the photoconductor drum 102BK is transferred to the intermediate transfer belt 106 in a transfer region TBk by the transfer roller 105BK. The cleaning device 111BK recovers residual toner at a position between the transfer region TBk and a charging unit of the charger 103BK in the direction in which the photoconductor drum 102BK rotates. The residual toner is toner that is not transferred to the intermediate transfer belt 106 but remains on the photoconductor drum 102BK.

The cleaning devices 111Y, 111M, 111C, and 111BK according to the present embodiment include blades, which contact the photoconductor drums, and recover residual toner by scraping the residual toner that remains on the photoconductor drums by using the blades.

The color toner images transferred to the intermediate transfer belt 106 are transferred to a recording sheet, which has been transported from the sheet feeder 109, in a transfer region T2 by the transfer roller 107. The toner images transferred to the recording sheet in the transfer region T2 are fixed to the recording sheet by the fixing unit 108. After the toner images have been fixed, the recording sheet is output to the sheet output tray 110.

The image forming apparatus 100 includes the cleaning device 112, which is disposed at a position between the transfer region T2 and the transfer region Ty in the rotation direction of the intermediate transfer belt 106. The cleaning device 112, which includes a blade that contacts the intermediate transfer belt 106, cleans the intermediate transfer belt 106 by scraping residual toner, which remains on the intermediate transfer belt 106 instead of being transferred to the recording medium, from the intermediate transfer belt 106 by using the blade.

Regarding the structure described below, the embodiment may be a monochrome image forming apparatus having a single photoconductor drum or an image forming apparatus that directly transfers toner images formed on a plurality of photoconductor drums to a recording medium (transfer member).

(Door and Recovered Toner Container of Image Forming Apparatus)

Figure 2:
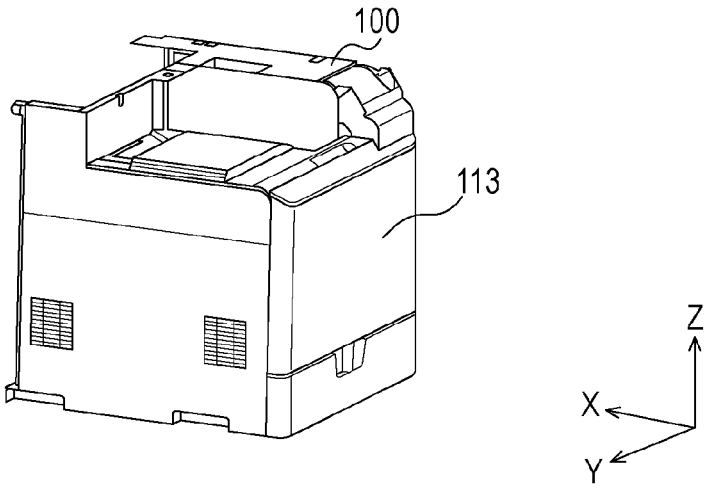
FIG. 2 illustrates external perspective views of the image forming apparatus.
Figure 2:
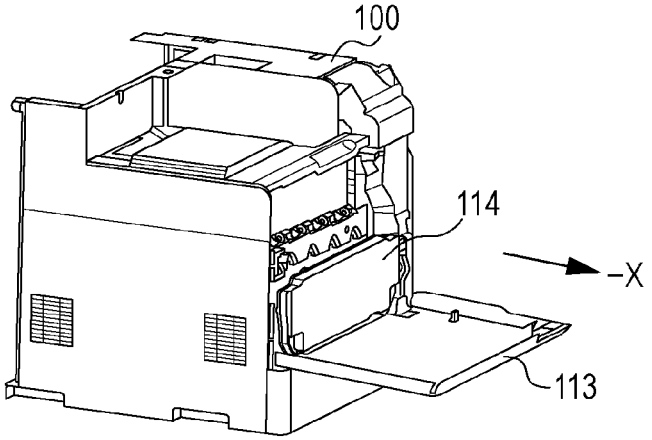
Figure 2:
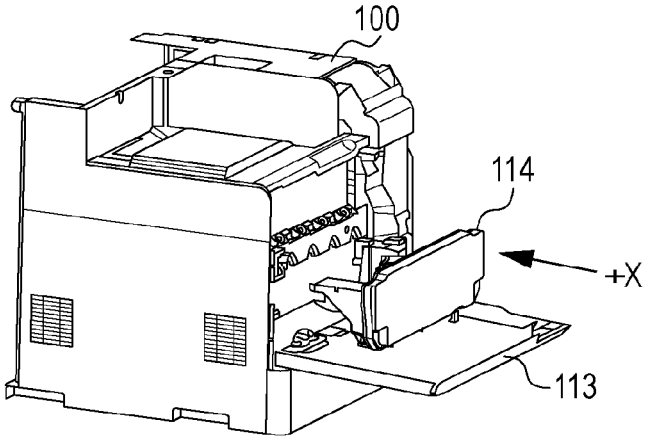

FIG. 2 illustrates external perspective views of the image forming apparatus 100. As illustrated in FIG. 2, the image forming apparatus 100 according to the present embodiment includes a maintenance door 113. A recovered toner container 114 is attached to the inside of the door 113 of the image forming apparatus 100. The recovered toner container 114 stores toner that the cleaning devices 111Y, 111M, 111C, and 111BK have recovered from the photoconductor drums and toner that the cleaning device 112 has recovered from the intermediate transfer belt 106. The recovered toner container 114 is a replacement unit that is attachable to and detachable from the body of the image forming apparatus 100. When a message indicating replacement of the recovered toner container 114 is displayed on a display unit (not shown), a user performs an operation of replacing the recovered toner container 114.

As illustrated in FIG. 2(*b*), the user detaches the recovered toner container 114 from the image forming apparatus 100 by moving the recovered toner container 114, which is attached to the image forming apparatus 100, in the −X direction (a state shown in FIG. 2(*c*)). On the other hand, when the user moves the recovered toner container 114 in the +X direction from the state shown in FIG. 2(*c*), the recovered toner container 114 is attached to the image forming apparatus 100 as illustrated in FIG. 2(*b*). In the state in which the recovered toner container 114 is attached to the image forming apparatus 100, the user cannot detach a process cartridge.

(Recovered Toner Container)

Figure 3A:
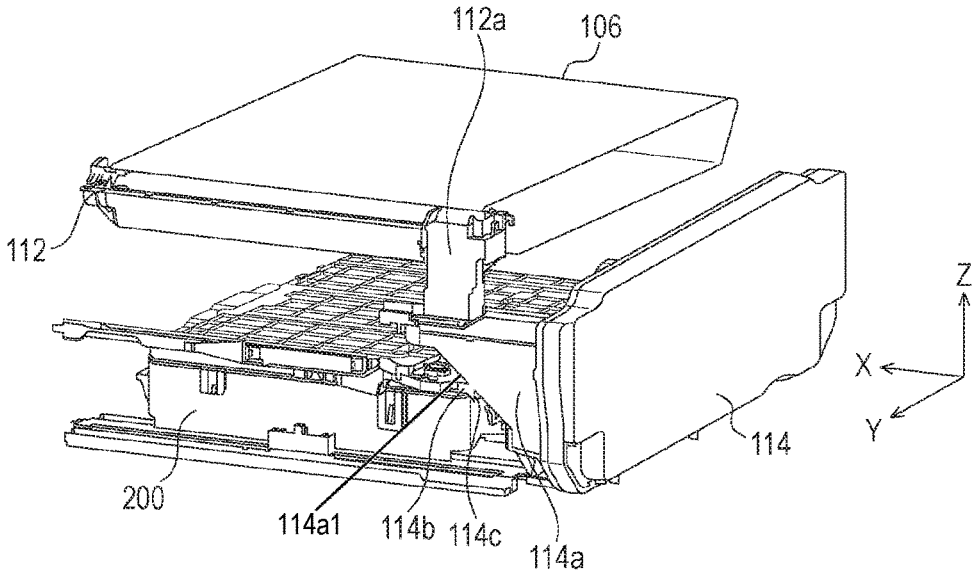
FIG. 3A illustrates a view showing a state in which a recovered toner container is connected to a cleaning device and a perspective view of a recovered toner container 114.
Figure 3A:
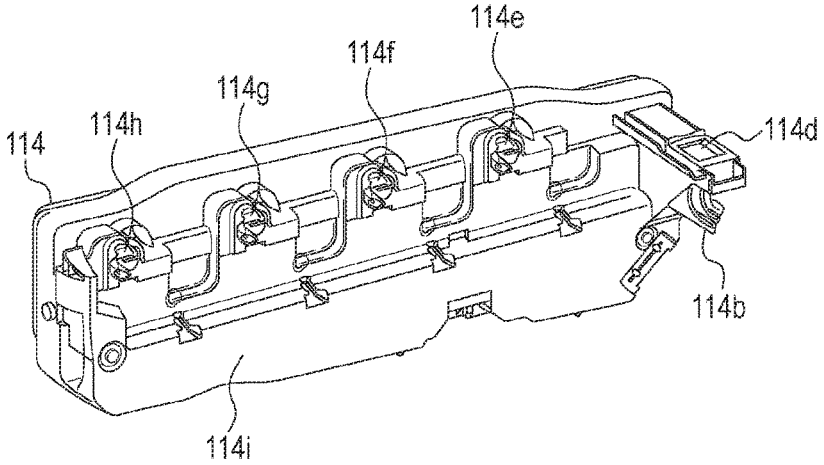

FIG. 3A(a) illustrates a state in which the recovered toner container 114 is connected to the cleaning device 112. FIG. 3A(b) is a perspective view of the recovered toner container 114.

Figure 3B:
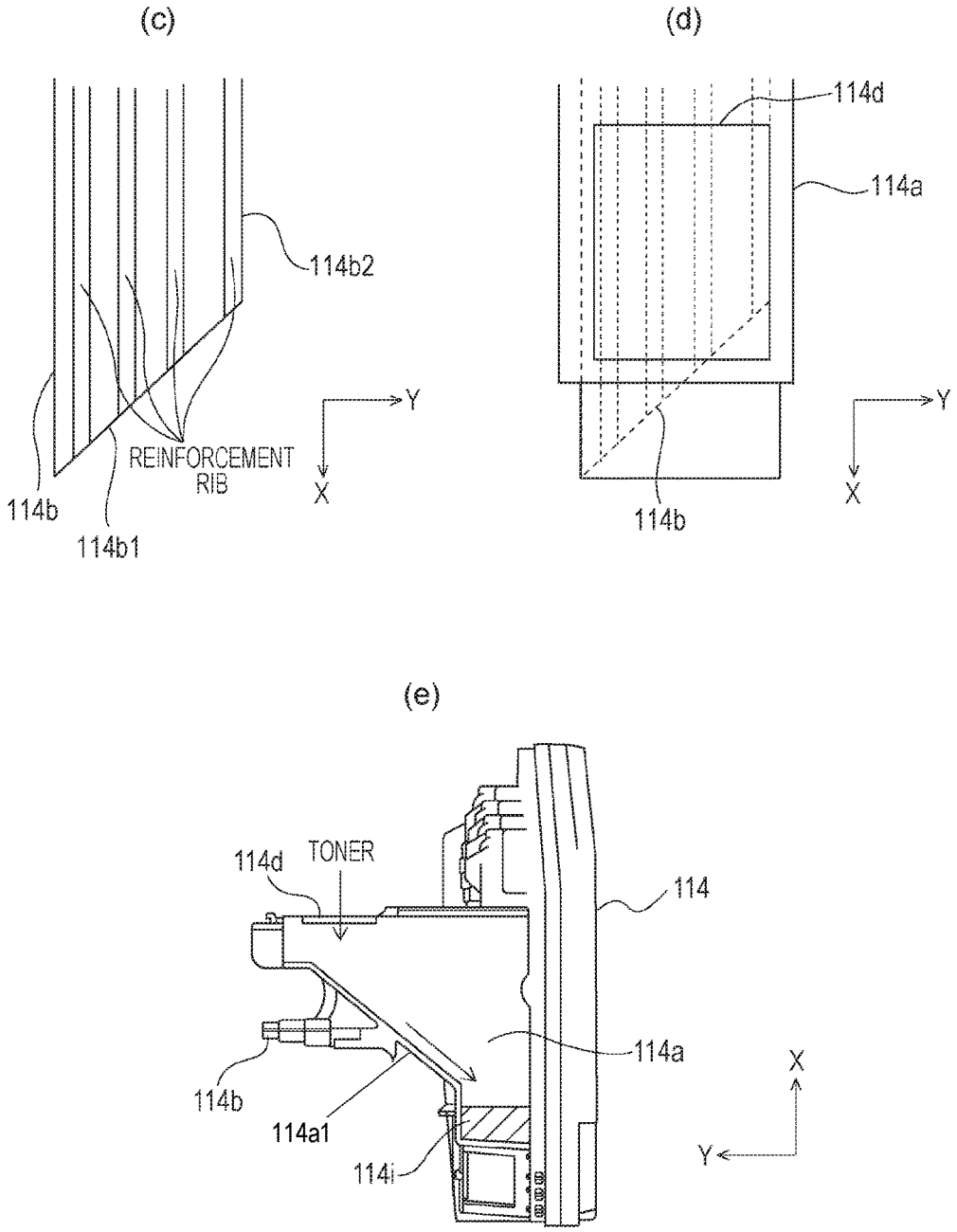
FIG. 3B illustrates a protruding portion and contact surfaces of the recovered toner container.

As illustrated in FIG. 3A(b), a toner transport path 114*a*, which is connected to the cleaning device 112, is integrally formed in the recovered toner container 114. The toner transport path 114*a* has a toner receiving hole 114*d*, through which toner is received from the cleaning device 112. In a state in which the recovered toner container 114 is attached to the image forming apparatus, the toner receiving hole 114*d* is connected to a toner transport path 112*a* of the cleaning device 112. Toner that the cleaning device 112 has collected during an image forming operation is moved by a transporting screw (not shown), passes along the toner transport path 112*a* of the cleaning device 112 and the toner transport path 114*a* of the recovered toner container 114, and is recovered to a toner containing portion 114*i* of the recovered toner container 114. The toner transport path 114*a* has an inclined surface 114*a*1 shown in FIG. 3A(a) so that toner received through the toner receiving hole 114*d* can be deposited not in the toner transport path 114*a* but in the toner containing portion 114*i*. As illustrated in FIG. 3B(e), the inclined surface 114*a*1 is a flat surface (or a curved surface) descending from a position directly below the toner receiving hole 114*d* to the toner containing portion 114*i*. In the present embodiment, the inclined surface 114*a*1 of the recovered toner container 114 has an angle of about 45 degrees with respect to the X-axis. The width of the inclined surface 114*a*1 in the Y-axis direction is about 25 mm, and the thickness of the inclined surface 114*a*1 is about 3 mm. By providing the toner transport path 114*a* with the inclined surface 114*a*1, toner received through the toner receiving hole 114*d* can be transported to the toner containing portion 114*i* without allowing the toner to be deposited in the toner transport path 114*a*.

Figure 8:
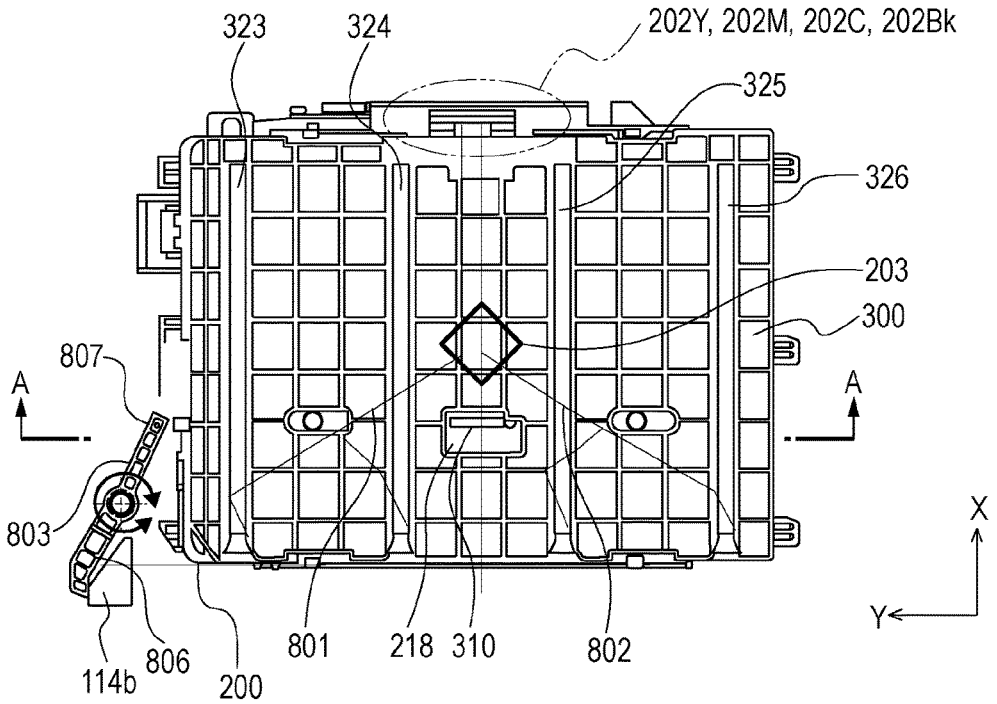
FIG. 8 illustrates a top view of a shutter moving mechanism, the shutter, and an optical scanning device disposed in a body of an image forming apparatus.
Figure 8:
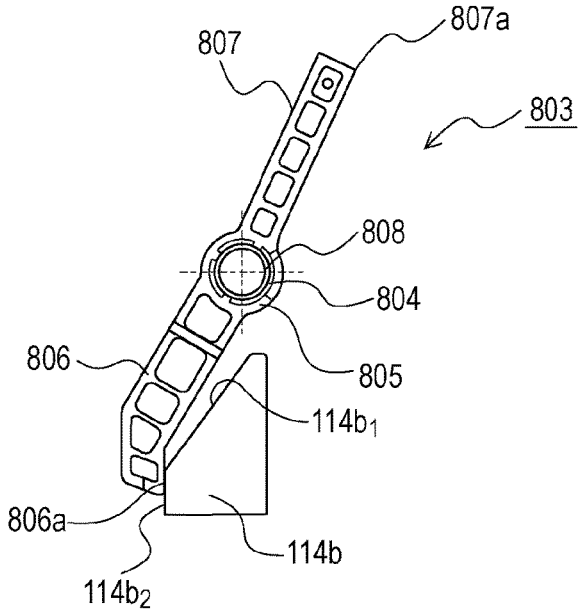

FIG. 8(*a*) is a top view of the shutter moving mechanism, the shutter, and the optical scanning device disposed in the body of the image forming apparatus 100. FIG. 8(*b*) is a top view of a rotation mechanism 803 included in the shutter moving mechanism.

A sponge member or a rubber member, which serves as a sealing member, is disposed so as to surround the toner receiving hole 114*d* of the recovered toner container 114*a*. In a state in which the recovered toner container 114*a* is attached to a predetermined position, the sealing member seals a gap between the toner receiving hole 114*d* and the toner transport path 112*a* of the cleaning device 112. With the sealing member, toner does not easily pass through the gap between the toner transport path 112*a* and the toner receiving hole 114*d* to the outside.

The recovered toner container 114 has receiving holes 114*e*, 114*f*, 114*g*, and 114*h*, which respectively receive toner transported from the cleaning devices 111Y, 111M, 111C, and 111BK. The receiving hole 114*e* is connected to the cleaning device 111Y, the receiving hole 114*f* is connected to the cleaning device 111M, the receiving hole 114*g* is connected to the cleaning device 111C, and the receiving hole 114*h* is connected to the cleaning device 111BK. Toner received through the receiving holes 114*e*, 114*f*, 114*g*, and 114*h* is deposited in the toner containing portion 114*i*.

The recovered toner container 114 further includes a protruding portion 114*b*. In the present embodiment, the protruding portion 114*b* of the recovered toner container 114 stands on the inclined surface 114*a*1 so as to extend along the X-axis direction. As illustrated in FIG. 3B(d), the protruding portion 114*b* is disposed directly below the toner receiving hole 114*d* of the transport path 114*a* in the Z-axis direction.

As illustrated in FIG. 8(*b*) corresponding to FIG. 3B(c), the protruding portion 114*b* has a first flat surface 114*b*1 (first contact surface) and a second flat surface 114*b*2 (second contact surface). The first flat surface 114*b*1 is inclined with respect to an imaginary plane (XZ-plane) that is parallel to a direction (X-axis direction) in which the recovered toner container 114 moves when the recovered toner container 114*b* is attached or detached. The second flat surface 114*b*2 is continuous with the first flat surface 114*b*1 and parallel to the imaginary plane. The second flat surface 114*b*2 may be inclined with respect to the imaginary plane. However, the inclination angle of the second flat surface 114*b*2 with respect to the imaginary plane may be smaller than the inclination angle of the first flat surface 114*b*1 with respect to the imaginary plane. In the present embodiment, the angle between the imaginary plane and the second flat surface 114*b*2 is substantially 0 degrees. As illustrated in FIG. 3B(c), the protruding portion 114*b* includes a plurality of reinforcement ribs extending along the X-axis, so that the protruding portion 114*b* does not become deformed easily when a certain load is applied to the protruding portion 114*b*. The function of the protruding portion 114*b* will be described below.

Figure 4:
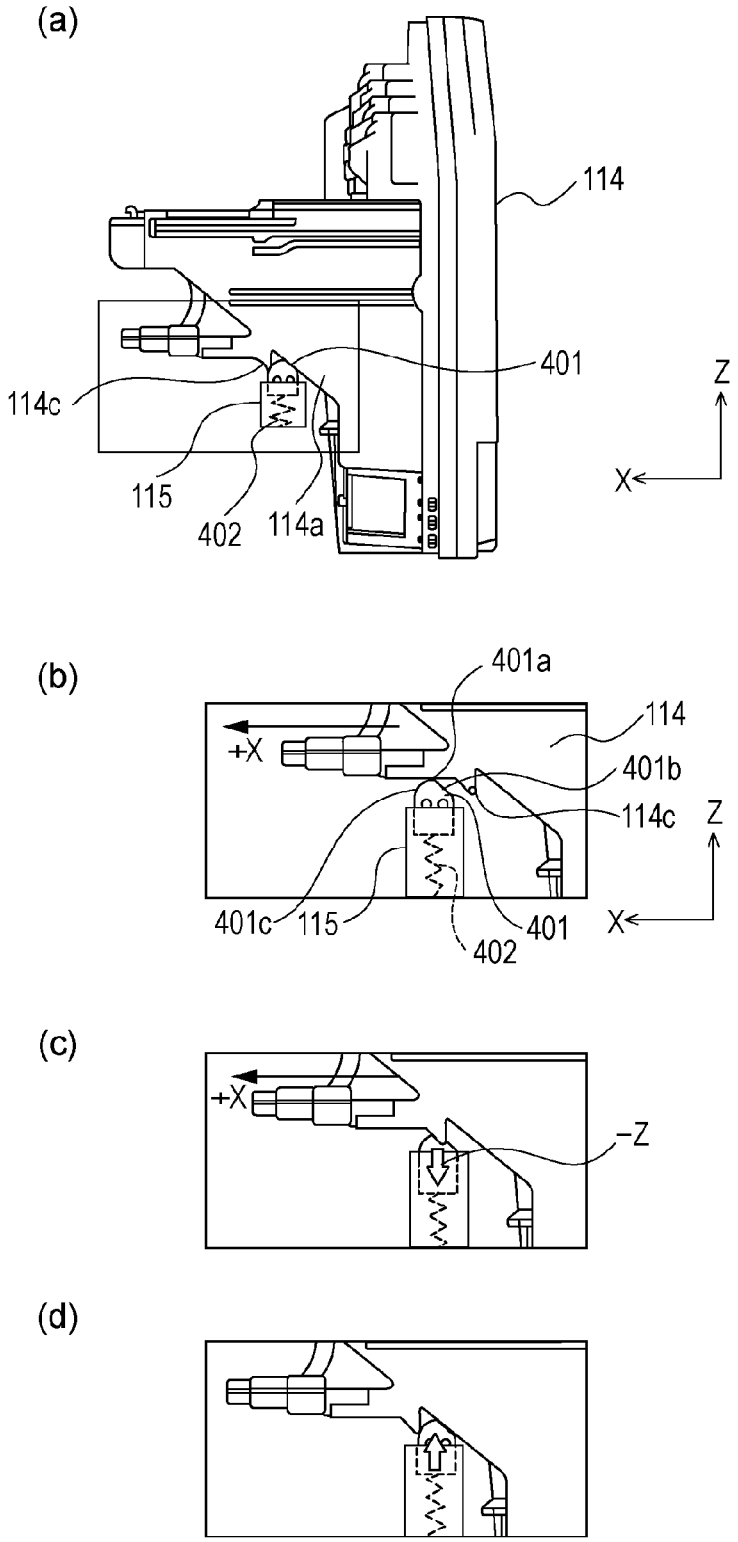
FIG. 4 illustrates a view showing a state in which the recovered toner container is attached to the image forming apparatus and enlarged views of a region surrounding a toner container holding mechanism.

FIG. 4(*a*) illustrates a state in which the recovered toner container 114 is attached to the image forming apparatus 100. The image forming apparatus 100 includes a toner container holding mechanism 115 (toner container holding unit) that holds the recovered toner container 114 with a strength that allows a user to easily attach and detach the recovered toner container 114. The toner container holding mechanism 115 includes a movement member 401, which contacts a protrusion 114*c* (positioning protrusion) formed on the recovered toner container 114; and a spring 402 attached to the movement member 401.

FIGS. 4(*b*) to 4(*d*) are enlarged views of a region surrounding the toner container holding mechanism 115, illustrating an exemplary operation performed by the toner container holding mechanism 115 when the recovered toner container 114 is attached to and detached from the image forming apparatus. FIG. 4(*b*) illustrates a state before the recovered toner container 114 is attached to a position (a predetermined position) at which the recovered toner container 100 receives toner from each of the cleaning devices. FIG. 4(*d*) illustrates a state after the recovered toner container 114 has been attached to the predetermined position. FIG. 4(*c*) illustrates a state between the states shown in FIGS. 4(*a*) and 4(*d*).

As illustrated in FIG. 4(*b*), the movement member 401 has a ridge portion 401*a*, an inclined surface 401*b* inclined toward the door 113 from the ridge portion 401*a*, and an inclined surface 401*c* inclined toward the optical scanning device 200 from the ridge portion 401*a*. The ridge portion 401*a* is located at one end of the movement member 401, and the spring 402 is attached to the other end of the movement member 401.

When a user moves the recovered toner container 114 in the +X direction in FIG. 4(*b*) in order to attach the recovered toner container 114 to the image forming apparatus, as illustrated in FIG. 4(*c*), the positioning protrusion 114*c* of the recovered toner container 114 contacts the inclined surface 401*b*. When the user further moves the recovered toner container 114 in the +X direction, the inclined surface 401*b* is pressed by the positioning protrusion 114*c*. Then, the spring 402 becomes compressed, and the movement member 401, which is pressed by the positioning protrusion 114*c*, moves in the −Z direction. When the user further moves the recovered toner container 114 in the +X direction, a lower end of the positioning protrusion 114*c* and the ridge portion 401*a* come into contact with each other.

When the user further moves the recovered toner container 114 in the +X direction from the state in which the lower end of the positioning protrusion 114*c* and the ridge portion 401*a* are in contact with each other, the positioning protrusion 114*c* comes into contact with the inclined surface 401*c*, and the movement member 401 moves in the +Z direction shown in FIG. 4(*d*). When the recovered toner container 114 has moved to a predetermined position in the image forming apparatus, as illustrated in FIG. 4(*d*), the positioning protrusion 114*c* becomes engaged with the movement member 401, so that movement of the recovered toner container 114 in the −X direction is restricted and the recovered toner container 114 is attached to the predetermined position in the image forming apparatus. Besides the toner container holding mechanism 115 disposed as the position illustrated in FIGS. 4(*a*) to 4(*d*), the image forming apparatus includes a plurality of toner container holding mechanisms 115 for positioning the recovered toner container 114 in the image forming apparatus. With the plurality of toner container holding mechanisms, the recovered toner container 114 can be securely held at a predetermined position in the image forming apparatus.

(Attachment and Detachment of Process Cartridge)

Figure 5:
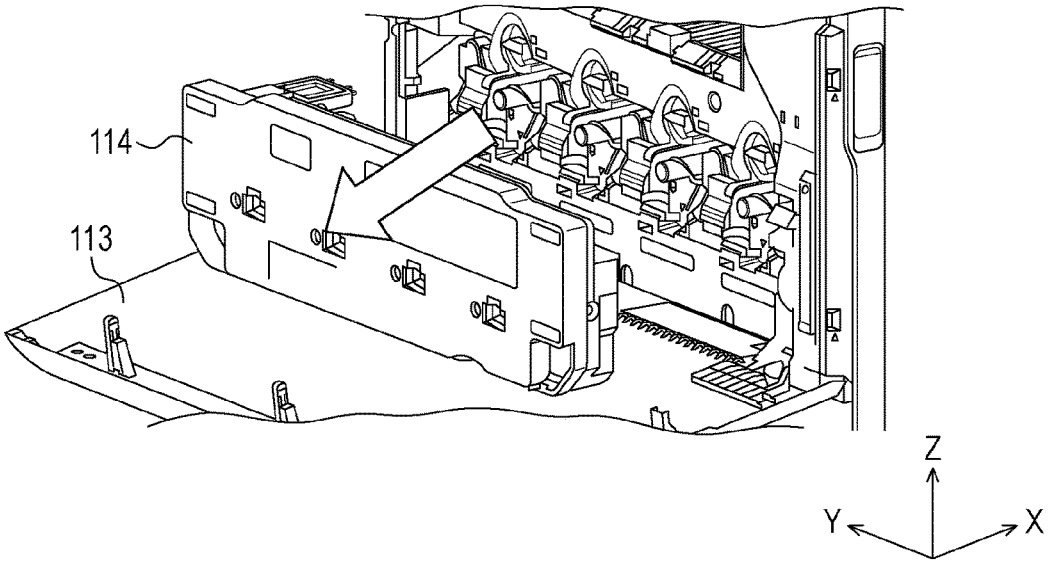
FIG. 5 illustrates a structure for attaching and detaching of a process cartridge.
Figure 5:
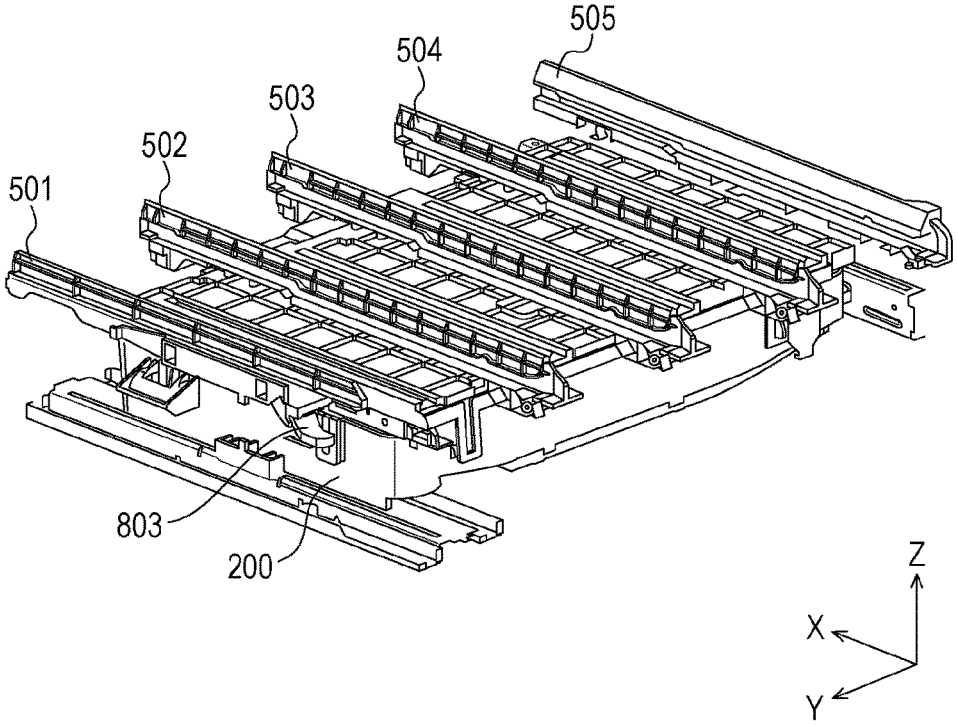

As described above, the process cartridges 101Y, 101M, 101C, and 101BK are replacement units that are attachable to and detachable from the body of the image forming apparatus. As illustrated in FIG. 5(*b*), the image forming apparatus 100 includes holding rails 501, 502, 503, 504, and 505 (cartridge holding units) for holding the process cartridges. The holding rails 501 and 502 hold the process cartridge 101Y. Moreover, the holding rail 501 and 502 also have the function of guide rails (guide members) that guide movement of the process cartridge 101Y when the process cartridge 101Y is moved in the +X direction or in the −X direction so as to be attached or detached. The holding rail 502 and the holding rail 503 hold the process cartridge 101M, the holding rail 503 and the holding rail 504 hold the process cartridge 101C, and the holding rail 504 and the holding rail 505 hold the process cartridge 101BK. Description of the functions of the holding rails 503 to 505, which are the same as those of the holding rails 501 and 502, will be omitted.

When the recovered toner container 114 is attached to the image forming apparatus, a part of a process cartridge is covered by the recovered toner container 114. Therefore, in this state, the process cartridge cannot be detached from the image forming apparatus.

Therefore, when replacing a process cartridge, a user opens the door 113 and then detaches the recovered toner container 114 from the image forming apparatus 100. When the recovered toner container 114 is detached from the image forming apparatus, as illustrated in FIG. 5(*a*), the process cartridges 101Y, 101M, 101C, and 101BK can be slid in the −X direction. The user slides the process cartridge, which is to be replaced, in the −X direction to extract the used process cartridge from the body of the image forming apparatus 100. Subsequently, the user slides a new process cartridge in the +X direction to attach the new cartridge to the body of the image forming apparatus 100. Lastly, the user attaches the recovered toner container 114 to the image forming apparatus 100 and closes the door 113. When the user has performed the above operations, replacement of the process cartridge is finished.

(Optical Scanning Device)

Figure 6:
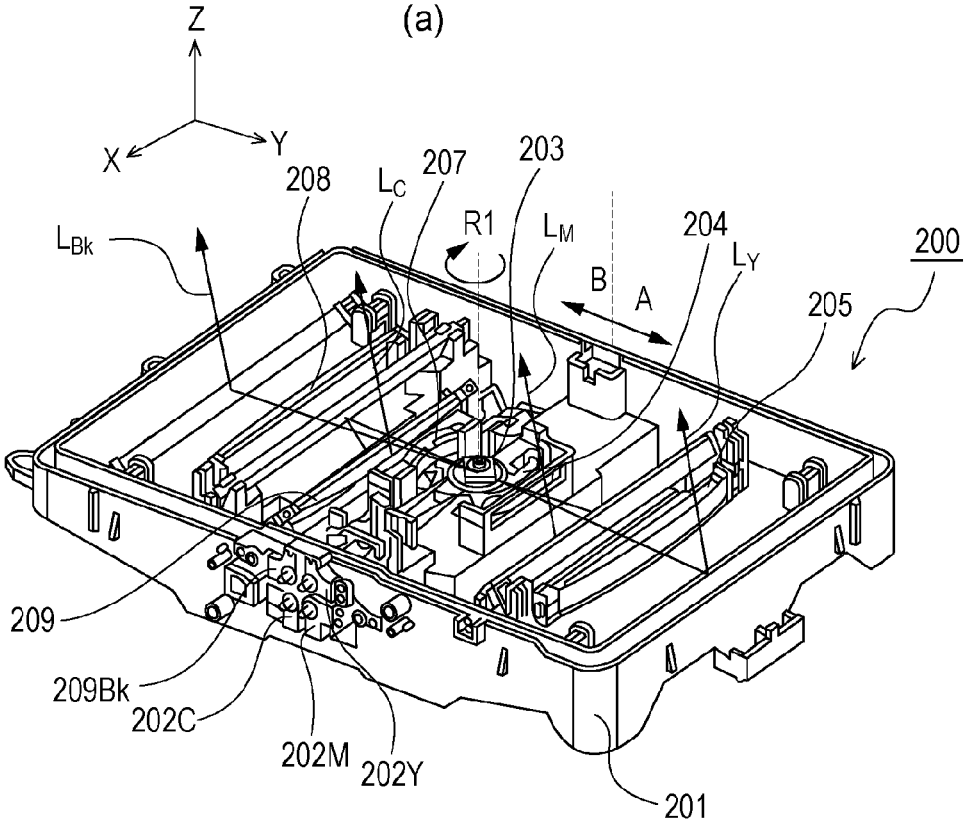
FIG. 6 illustrates a perspective view showing the structure of an optical scanning device and a sectional view of the optical scanning device.
Figure 6:
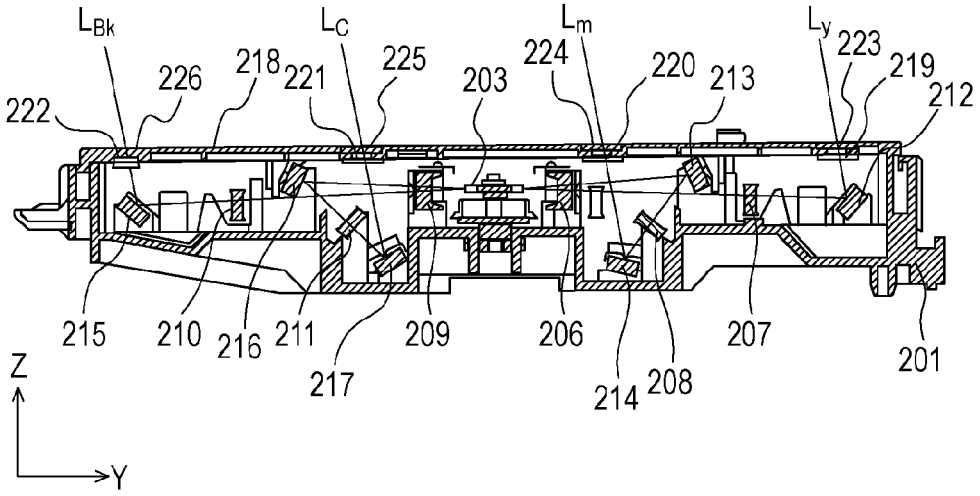

Next, the optical scanning device 200 will be described. FIG. 6(*a*) is a perspective view showing the structure of the optical scanning device 200, and FIG. 6(*b*) is a sectional view of the optical scanning device 200.

As illustrated in FIG. 6(*a*), light source units 202Y, 202M, 202C, and 202BK are attached to an outer wall of an optical box (housing) 201 of the optical scanning device 200. The light source unit 202Y emits a laser beam LY for exposing the photoconductor drum 102Y, and the light source unit 202M emits a laser beam LM for exposing the photoconductor drum 102M. The light source unit 202C emits a laser beam for exposing the photoconductor drum 102C, and the light source unit 202BK emits a laser beam LBK for exposing the photoconductor drum 102BK.

The light source units 202Y, 202M, 202C, and 202BK are disposed close to each other. Here, a flat surface that is perpendicular to the rotation axis of a polygon mirror 203 and that crosses the polygon mirror 203 is defined as an imaginary plane. The laser beam LY emitted from the light source unit 202Y and the laser beam LBK emitted from the light source unit 202Bk are incident on a reflection surface of the polygon mirror 203 along optical paths that diagonally cross the imaginary plane from above in the direction of gravity. The laser beam LC emitted from the light source unit 202C and the laser beam LM emitted from the light source unit 202M are incident on a reflection surface of the polygon mirror 203 along optical paths that diagonally cross the imaginary plane from below in the direction of gravity.

As illustrated in FIG. 6(*a*), the polygon mirror (rotating polygon mirror) 203, which has four reflection surfaces, is disposed at a central portion of the optical box 201. During an image forming operation, the polygon mirror 203 rotates around the rotation axis, which is indicated by a dotted line in FIG. 6(*a*), in a direction R1.

The laser beam LY emitted from the light source unit 202Y is incident on a reflection surface of the polygon mirror 203. The laser beam LY is deflected (reflected) by the reflection surface of the polygon mirror 203 in a direction A shown in FIG. 6(*a*). The laser beam LM emitted from the light source unit 202M is incident on the same reflection surface of the polygon mirror 203 as the reflection surface on which the laser beam LY is incident. The laser beam LM is deflected by the reflection surface of the polygon mirror 203 in the same direction (direction A) as the laser beam LY is.

On the other hand, the laser beam LBK emitted from the light source unit 202BK is incident on a reflection surface that is different from the reflection surface on which the laser beams LY and LM are incident. The laser beam LBK is deflected by the reflection surface of the polygon mirror 203 in a direction B shown in FIG. 6(*a*). The laser beam LC emitted from the light source unit 202C is incident on the same reflection surface of the polygon mirror 203 as the reflection surface on which the laser beam LBK is incident. The laser beam LC is deflected by the reflection surface of the polygon mirror 203 in the same direction (direction B) as the laser beam LBK is.

After having been deflected by the polygon mirror 203, the laser beams LY and LM become laser beams that travel in the +X direction. That is, by being deflected by the rotating polygon mirror 203, the laser beam LY becomes a laser beam that scans the photoconductor drum 102Y in the +X direction and the laser beam LM becomes a laser beam that scans the photoconductor drum 102M in the +X direction.

On the other hand, after having been deflected by the polygon mirror 203, the laser beams LBK and LC become laser beams that travel in the −X direction. That is, by being deflected by the rotating polygon mirror 203, the laser beam LBK becomes a laser beam that scans the photoconductor drum 102BK in the −X direction and the laser beam LC becomes a laser beam that scans the photoconductor drum 102C in the −X direction.

Next, referring to FIG. 6(*b*), the optical paths of the laser beams LY, LM, LC, and LBK deflected by the polygon mirror 203 will be described. As illustrated in FIG. 6(*b*), optical components, such as the polygon mirror 203; lenses 206, 207, 208, 209, 210, and 211; and reflection mirrors 212, 213, 214, 215, 216, and 217, are attached to the inside of the optical box 201. Moreover, a cover 218, which protects the polygon mirror 203, the lenses, and the reflection mirrors against dust, is attached to the optical box 201.

The laser beam LY deflected by the polygon mirror 203 passes through the lens 206 and the lens 207, and is incident on the reflection mirror 212. The reflection mirror 212 reflects the incident laser beam LY toward the photoconductor drum 102Y. The cover 218 has an opening 219, which allows the laser beam LY reflected by the reflection mirror 212 to pass therethrough. The opening 219 is closed by a transparent dustproof window 220, which allows the laser beam LY to pass therethrough. The laser beam LY passed through the dustproof window 220 forms an image on the photoconductor drum 102Y.

The laser beam LM deflected by the polygon mirror 203 passes through the lens 206 and is incident on the reflection mirror 213. The reflection mirror 213 reflects the incident laser beam LM toward the reflection mirror 214 and the lens 208. By being reflected by the reflection mirror 213, the laser beam LM passes through the lens 208 and is incident on the reflection mirror 214. The reflection mirror 214 reflects the incident laser beam LM toward the photoconductor drum 102M. The cover 218 has an opening 220, which allows the laser beam LM reflected by the reflection mirror 214 to pass therethrough. The opening 219 is closed by a transparent dustproof window 224, which allows the laser beam LM to pass therethrough. The laser beam LM passed through the dustproof window 224 forms an image on the photoconductor drum 102M.

The laser beam LBK deflected by the polygon mirror 203 passes through the lens 209 and the lens 210 and is incident on the reflection mirror 215. The reflection mirror 215 reflects the incident laser beam LBK toward the photoconductor drum 102BK. The cover 218 has an opening 222, which allows the laser beam LBK reflected by the reflection mirror 215 to pass therethrough. The opening 222 is closed by a transparent dustproof window 226, which allows the laser beam LBK to pass therethrough. The laser beam LBK passed through the dustproof window 222 forms an image on the photoconductor drum 102BK.

The laser beam LC deflected by the polygon mirror 203 passes through the lens 209 and is incident on the reflection mirror 216. The reflection mirror 216 reflects the incident laser beam LC toward the lens 211. The laser beam LM reflected by the reflection mirror 211 passes through the lens 211 and is incident on the reflection mirror 217. The reflection mirror 217 reflects the incident laser beam LC toward the photoconductor drum 102C. The cover 218 has an opening 221, which allows the laser beam LC reflected by the reflection mirror 218 to pass therethrough. The opening 221 is closed by a transparent dustproof window 225, which allows the laser beam LC to pass therethrough. The laser beam LC passed through the dustproof window 225 forms an image on the photoconductor drum 102C.

(Cover)

Figure 7:
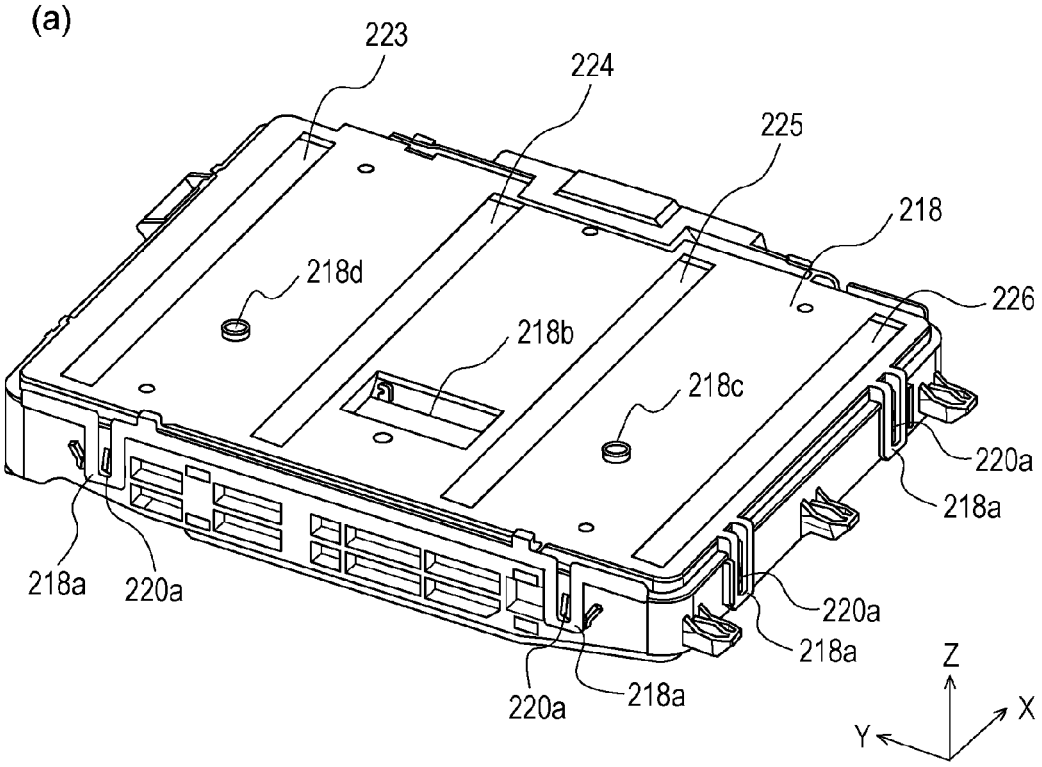
FIG. 7 illustrates perspective views of an optical box and a shutter.
Figure 7:
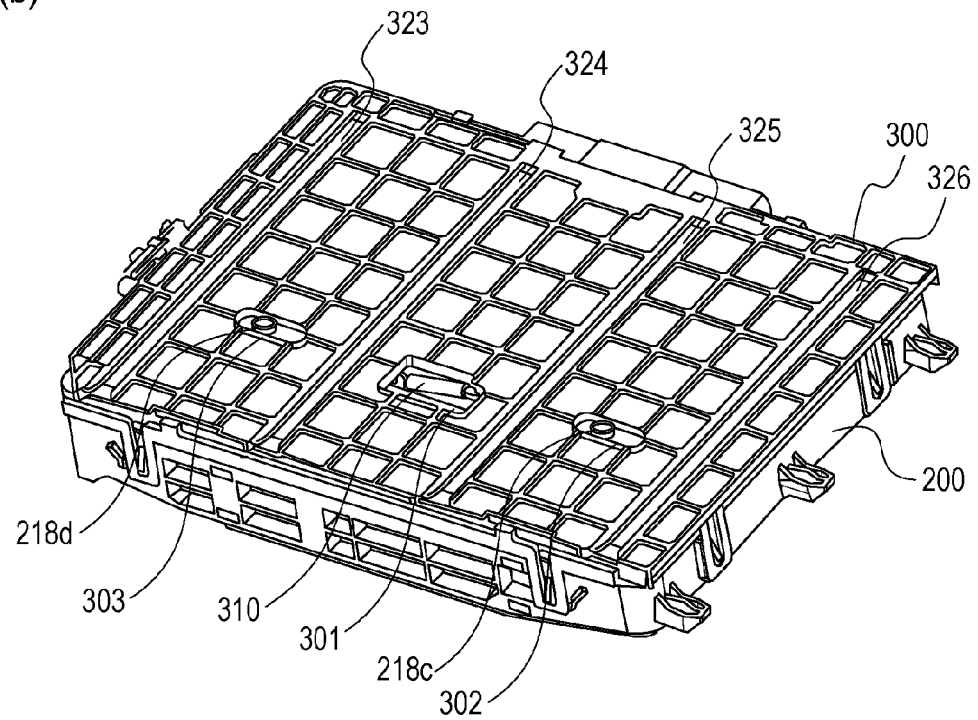

The cover 218 will be described. As illustrated in FIG. 7(*a*), the cover 218 is attached to the optical box 201. The cover 218 includes a plurality of hook portions 218*a*. The cover 218 is attached to the optical box 201 by snap-fitting the plurality of hook portions 218*a* to a plurality of protrusions 220*a* formed on outer walls of the optical box. As illustrated in FIG. 7(*a*), the cover 218 includes recessed portions 218*b*, which are recessed toward the inside the optical box 201, and protruding portions 218*c* and 218*d*, which protrude toward the outside of the optical box 201.

(Shutter)

Next, a shutter 300 will be described. The shutter 300 is a member for preventing foreign substances, such as toner, from adhering to dustproof windows 223, 224, 225, and 226. When a user opens the door 113 and attaches or detaches a process cartridge to or from the image forming apparatus in order to perform maintenance of the image forming apparatus, toner may fall from the cartridge due to movement of the process cartridge. Therefore, at least when replacing the process cartridge, it is desirable that the dustproof windows 223, 224, 225, and 226 be covered by the shutter 300.

FIG. 7(*b*) is a perspective view showing the shutter 300, which is attached to the optical scanning device so as to cover the cover 218. The shutter 300 is a plate-shaped resin member that faces the cover 218 and is a common component that covers all of the dustproof windows 223, 224, 225, and 226. The shutter 300 has an opening 323 (light beam passing portion), which allows the laser beam LY passed through the dustproof window 223 to pass therethrough; an opening 324 (light beam passing portion), which allows the laser beam LM passed through the dustproof window 224 to pass therethrough; an opening 325 (light beam passing portion), which allows the laser beam LC passed through the dustproof window 225 to pass therethrough; and an opening 326 (light beam passing portion), which allows the laser beam LBK passed through the dustproof window 226 to pass therethrough. Moreover, the shutter 300 has an elongated hole 301 for attaching a spring 310, which is an elastic member described below. Furthermore, the shutter 300 has elongated holes 302 and 303. The protruding portion 218*c* of the cover 218 is inserted into the elongated hole 302. The protruding portion 218*d* of the shutter 300 is inserted into the elongated hole 303. The elongated holes 302 and 303 and the protruding portions 218*c* and 218*d* constitute an engagement mechanism in which the elongated hole 302 and the protruding portion 218*c* and the elongated hole 303 and the protruding portion 218*d* respectively become engaged with each other. Therefore, the elongated holes 302 and 303 and the protruding portions 218*c* and 218*d* function as guide members that restrict the direction of movement of the cover 218 to the Y-axis direction. The elongated holes 302 and 303 are elongated in a direction parallel to the Y-axis of the shutter 300. Therefore, due to the presence of the elongated holes 302 and 303 and the protruding portions 218*c* and 218*d*, movement of the shutter 300 is restricted to reciprocating directions parallel to the Y-axis. The shutter 300 may be attached to the image forming apparatus.

The shutter 300 may have the protruding portion, the cover 218 may have recessed portions (insertion portions) corresponding to the openings, and protrusions formed on the shutter 300 may be inserted into the recessed portion so as to serve as guide members.

(Shutter Moving Mechanism)

The shutter 300 according to the present embodiment is provided in order to suppress adhesion of dust, such as toner, to the dustproof windows 223, 224, 225, and 226 of the cover 218. The shutter 300 is moved by a shutter moving mechanism described below.

As illustrated in FIG. 3A(b), a toner transport path 114*a*, which is connected to the cleaning device 112, is integrally formed in the recovered toner container 114. The toner transport path 114*a* has a toner receiving hole 114*d*, through which toner is received from the cleaning device 112. In a state in which the recovered toner container 114 is attached to the image forming apparatus, the toner receiving hole 114*d* is connected to a toner transport path 112*a* of the cleaning device 112. Toner that the cleaning device 112 has collected during an image forming operation is moved by a transporting screw (not shown), passes along the toner transport path 112*a* of the cleaning device 112 and the toner transport path 114*a* of the recovered toner container 114, and is recovered to a toner containing portion 114*i* of the recovered toner container 114. The toner transport path 114*a* has an inclined surface 114*a*1 shown in FIG. 3A(a) so that toner received through the toner receiving hole 114*d* can be deposited not in the toner transport path 114*a* but in the toner containing portion 114*i*. As illustrated in FIG. 3B(e), the inclined surface 114*a*1 is a flat surface (or a curved surface) descending from a position directly below the toner receiving hole 114*d* to the toner containing portion 114*i*. In the present embodiment, the inclined surface 114*a*1 of the recovered toner container 114 has an angle of about 45 degrees with respect to the X-axis. The width of the inclined surface 114*a*1 in the Y-axis direction is about 25 mm, and the thickness of the inclined surface 114*a*1 is about 3 mm. By providing the toner transport path 114*a* with the inclined surface 114*a*1, toner received through the toner receiving hole 114*d* can be transported to the toner containing portion 114*i* without allowing the toner to be deposited in the toner transport path 114*a*.

FIG. 8(*a*) is a top view of the shutter moving mechanism, the shutter, and the optical scanning device disposed in the body of the image forming apparatus 100. FIG. 8(*b*) is a top view of a rotation mechanism 803 included in the shutter moving mechanism.

As illustrated in FIG. 8(*b*), a rotation mechanism 803 includes a rotation shaft 804, a rotary portion 805, a first arm 806, and a second arm 807. The rotation shaft 804 is a fixed shaft that is disposed in the body of the image forming apparatus 100 and that has a circular cross section. The rotary portion 805, the first arm 806, and the second arm 807 constitute a single rotation member. The shaft 804 extends through an opening 808 formed in the rotary portion 805. The first arm 806 and the second arm 807 extend from the rotary portion 805 in the radial direction of the shaft 804.

As illustrated in FIG. 8(*a*), the rotation member, which includes the rotary portion 805, the first arm 806, and the second arm 807, can rotate around the rotation shaft 804 as the rotation axis (around the center of the circular cross section of the rotation shaft 804 as the rotation center) in the clockwise direction (a first direction) and in the counter-clockwise direction (a second direction opposite to the first direction).

Figure 9:
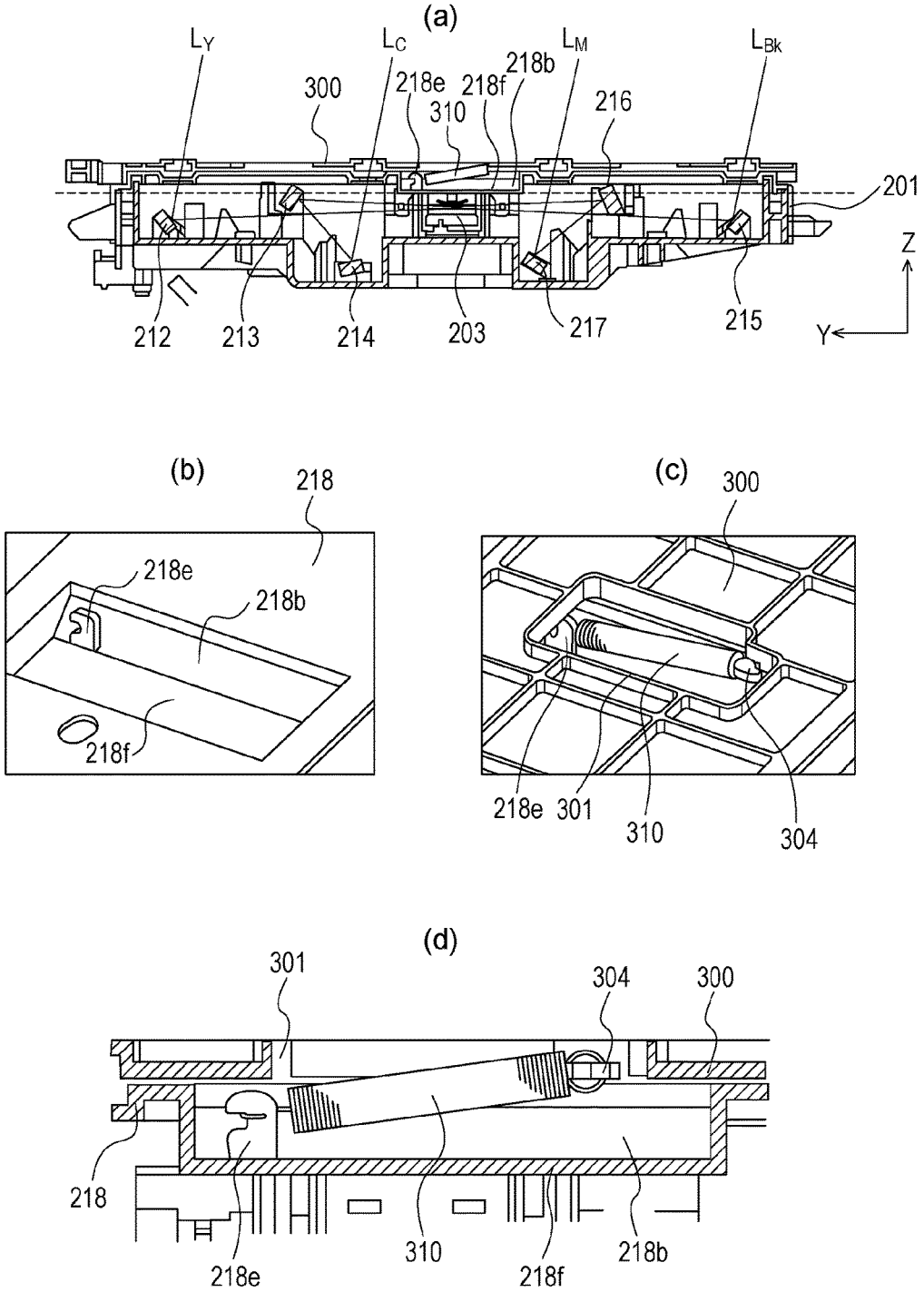
FIG. 9 illustrates the shutter moving mechanism.

Next, referring to FIG. 9, the spring 310, which is included in the shutter moving mechanism, will be described. FIG. 9(*a*) is a sectional view taken along line A-A of FIG. 8(*a*). FIG. 9(*b*) is an enlarged perspective view of the recessed portion 218*b* of the cover 218. FIG. 9(*c*) is an enlarged perspective view of the opening 301 of the shutter 300. FIG. 9(*d*) is an enlarged sectional view of a portion to which the spring 310 is attached.

As illustrated in FIG. 9(*b*), the recessed portion 218*b* of the cover 218 includes an engagement portion 218*e* (second connection portion) that engages with one end of the spring 310, which is a coil spring or the like. As illustrated in FIG. 9(*c*), the shutter 300 includes an engagement portion 304 (first connection portion) that engages with the other end of the spring 310. Thus, the cover 218 and the shutter 300 are connected to each other by the spring 310. In the present embodiment, an example in which the spring 310 connects the cover 218 and the shutter 300 to each other is described. However, the embodiment may have a structure in which the spring 310 connects the optical box 201 and the shutter member 300 to each other.

As illustrated in FIG. 9(*a*), in the direction of the rotation axis of the polygon mirror 203 (the Z-axis direction), a bottom surface 218*f* of the recessed portion 218*b* of the cover 218 is located closer to a bottom surface of the optical box 201 than the dustproof windows 223, 224, 225, and 226 are. As illustrated in FIG. 8(*a*), the recessed portion 218*b* of the cover 218 is disposed at a position at which the recessed portion 218*b* itself does not block the optical paths of laser beams in the optical scanning device. A quadrangle illustrated in FIG. 8(*a*) represents the position at which the rotating polygon mirror is disposed, and lines 801 and 802 represent end portions of a region scanned by laser beams deflected by the polygon mirror 203. The recessed portion 218*b* is disposed on extension lines of the optical paths of laser beams that are emitted from the light sources 202Y, 202M, 202C, and 202BK and incident on the polygon mirror 203. By disposing the recessed portion 218*b* on the extension lines of the optical paths of the laser beams that are emitted from the light sources 202Y, 202M, 202C, and 202BK and incident on the polygon mirror 203, the recessed portion 218*b* can be disposed so as not to block the optical paths of the laser beams in the optical scanning device and so as to protrude to a position that is located further inside the optical scanning device than the positions of the dustproof windows are located in the direction of the rotation axis of the polygon mirror 203. In other words, when seen in the direction of the rotation axis of the polygon mirror 203, the recessed portion 218*b* is disposed opposite the light sources 202Y, 202M, 202C, and 202BK with the polygon mirror 203 therebetween. As a result, the optical scanning device 200 can be prevented from becoming large when seen in the direction of the rotation axis of the polygon mirror 203.

(Operation of Shutter Moving Mechanism)

Next, referring to FIGS. 10 and 11, an operation of the shutter moving mechanism (shutter opening-closing mechanism) will be described.

Figure 10:
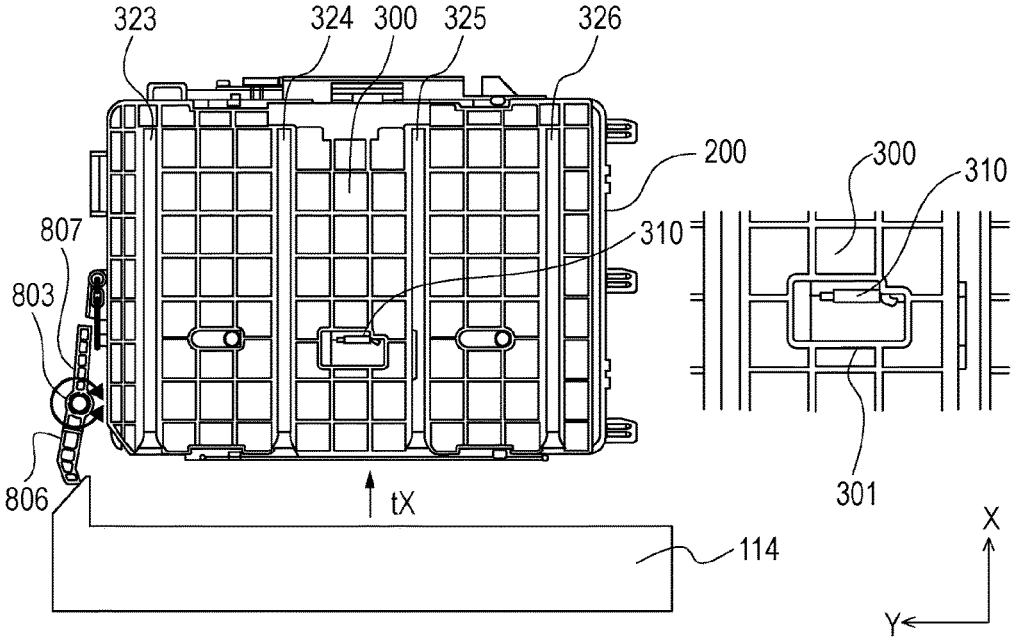
FIG. 10 illustrates an operation of the shutter moving mechanism (shutter opening-closing mechanism).
Figure 10:
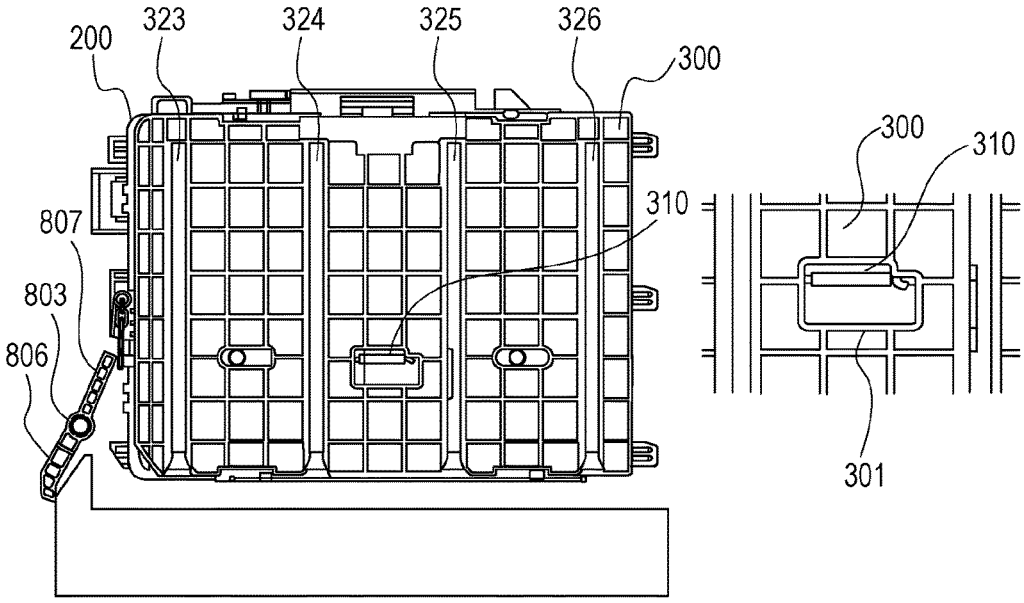

FIG. 10(*a*) is a top view showing a state before the recovered toner container 114 is attached to the toner container holding mechanism 115. In FIG. 10(*a*), the shutter 300 covers the openings 223, 224, 225, and 226 of the cover 218, and, if the laser beams LY, LM, LC, and LBK were emitted, the laser beams would be blocked by the shutter. In the present embodiment, the state shown in FIG. 10(*a*) will be referred to as a shutter closed state in which the shutter 300 blocks the laser beams or a state in which the shutter 300 is located at a second position at which the shutter 300 is located on the optical paths of the laser beams.

FIG. 10(*b*) is a top view showing a state in which the recovered toner container 114 is held by the toner container holding mechanism 115. In FIG. 10(*b*), the shutter 300 is located at a first position at which the shutter 300 is withdrawn from the optical paths of the laser beams. Therefore, the laser beams LY, LM, LC, and LBK can pass through the opening 223, 224, 225, and 226 of the shutter member 300. In the present embodiment, the state shown in FIG. 10(*a*) will be referred to as a shutter open state in which the shutter 300 does not block the laser beams.

In the state shown in FIG. 10(*a*), a distal end 806*a* of the first arm 806 (first movement portion) is in contact with the protruding portion 114*b* of the recovered toner container 114, and a distal end 807*a* of the second arm 807 (second movement portion) is in contact with an end portion of the shutter 300 (the left part of FIG. 10(*a*)). The right part of FIG. 10(*a*) illustrates the state of the spring 310 in the state illustrated in the left part of FIG. 10(*a*).

Figure 11:
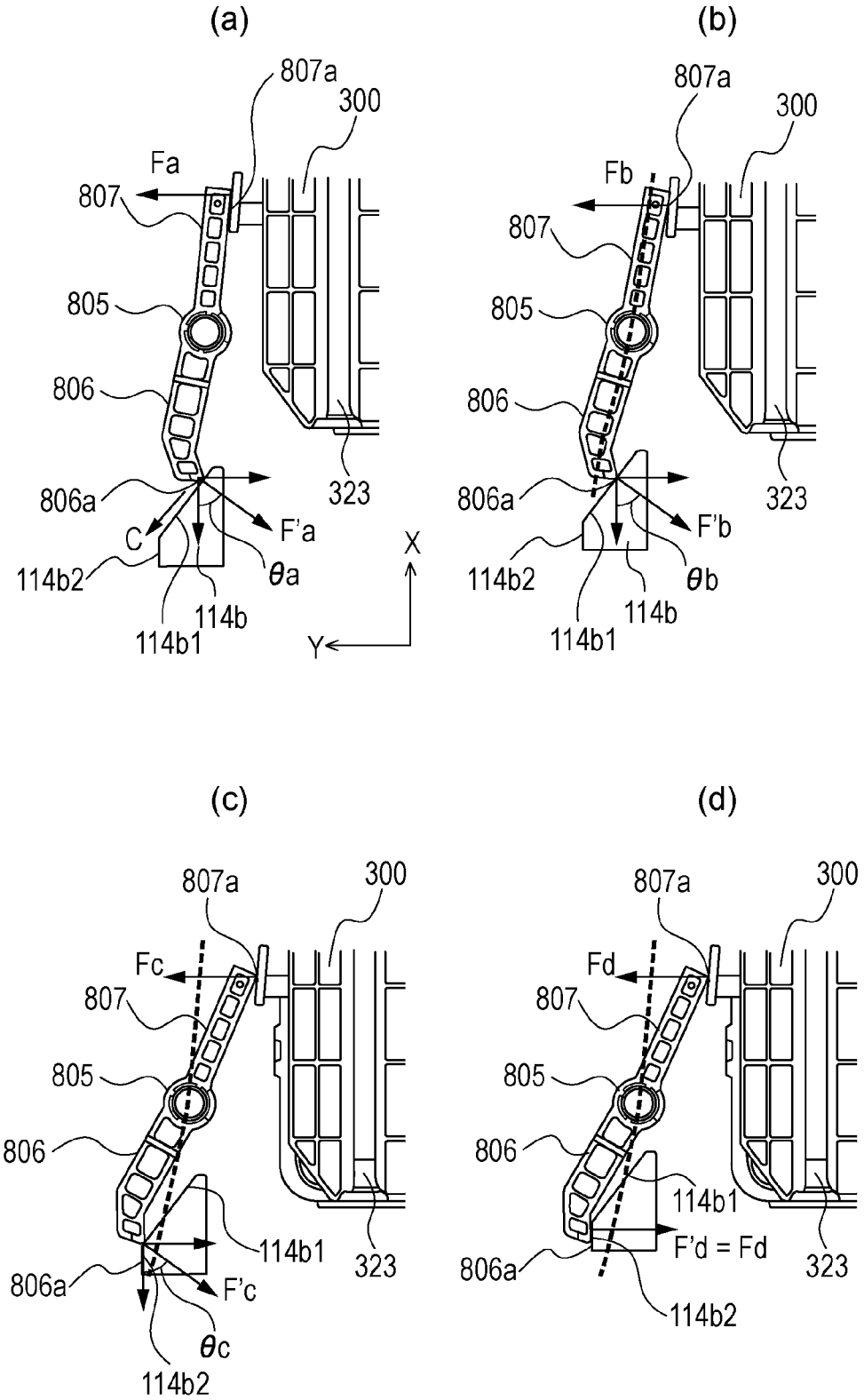
FIG. 11 illustrates an operation of the shutter moving mechanism (shutter opening-closing mechanism).

FIG. 11(*a*) is an enlarged view of the rotation mechanism 803 in the state shown in FIG. 10(*a*). The positions of the first arm 806 and the second arm 807 shown in FIG. 11(*a*) will be referred to as initial positions. In FIGS. 11(*b*) to 11(*d*), the initial positions of the first arm 806 and the second arm 807 are represented by dotted lines.

When a user moves the recovered toner container 114 in the +X direction from the state shown in FIG. 10(*a*), the distal end 806*a* of the first arm 806 moves along the first flat surface 114*b*1 of the protruding portion 114*b* in the direction of arrow C. Due to movement of the distal end 806*a* of the first arm 806 in the direction of arrow C, the first arm 806 rotates (moves) around the rotation shaft 804 as the rotation axis in the clockwise direction and, at the same time, the second arm 807 rotates (moves) in the clockwise direction (FIG. 11(*b*)).

Due to rotation of the first arm 806, the second arm 807 rotates and the distal end 807*a* of the second arm 807 presses the shutter 300. Accordingly, the shutter 300 slides in the −Y direction (a transversal direction of the transparent windows). When the shutter 300 slides in the −Y direction from the state shown in FIG. 11(*a*), the spring 310 becomes extended and the elastic force of the spring 310 (an urging force with which the spring 310 urges the shutter 300 in the +Y direction) is increased, and thereby a force in the +Y direction is applied to the shutter 300. Therefore, a state in which the shutter 300 and the distal end 807*a* of the second arm 807 are in contact with each other is maintained.

When the user further moves the recovered toner container 114 in the +X direction from the state shown in FIG. 11(*b*), the recovered toner container 114 moves in the +X direction, and therefore the first arm 806 and the second arm 807 rotate in the clockwise direction. The shutter 300 is pressed by the second arm 807 and further slides in the −Y direction (FIG. 11(*c*)).

In the state shown in FIG. 11(*c*), the recovered toner container 114 is not completely held by the toner container holding mechanism 115 of the image forming apparatus 100 and can further move in the +X direction. When the user further moves the recovered toner container 114 in the +X direction from the state shown in FIG. 11(*c*), the distal end 806*a* of the first arm 806 contacts the second flat surface 114*b*2 of the protruding portion 114*b*. The second flat surface 114*b*2 is parallel to the X-axis. Therefore, even when the distal end 806*a* of the first arm 806 moves along the second flat surface 114*b*, the first arm 806 and the second arm 807 do not rotate in any of the clockwise and counter clockwise directions.

When the first arm 806 and the second flat surface 114*b*2 of the protruding portion 114*b* are in contact with each other at the position shown in FIG. 11(*d*), the recovered toner container 114 is held by the toner container holding mechanism 115 as illustrated FIG. 4(*d*). By forming the second flat surface 114*b* as a flat surface parallel to the X-axis, when the distal end 806*a* of the first arm 806 and the second flat surface 114*b*2 are in contact with each other, a force is not applied from the distal end 806*a* of the first arm 806 to the protruding portion 114*b* in the −X direction. Thus, by forming the second flat surface 114*b*2 in this way, in the state shown in FIG. 4(*d*), detachment of the recovered toner container 114 from the toner container holding mechanism 115 in the −X direction due to vibration or the like can be suppressed.

A protruding portion 114*d* according to the present embodiment is disposed on the same side as the toner transport path 114*a* of the recovered toner container 114 in the Y-axis direction (a direction in which the plurality of photoconductor drums are arranged). In other words, in FIG. 10(*b*), the protruding portion 114*d* and the toner transport path 114*a* are disposed on the left side of a central portion of the recovered toner container 114 in the Y-axis direction. Therefore, even if a user detaches the recovered toner container 114 from the image forming apparatus while inclining the recovered toner container 114 with respect to the Y-axis, the shutter can be moved at the same time as the toner receiving portion 114*d* becomes disconnected from the toner transport path 112*a* of the cleaning device 112. Accordingly, even if toner falls from the toner transport path 112*a* of the cleaning device 112 and becomes scattered, the shutter 300 can suppress falling of the toner onto the plurality of dustproof windows.

Regarding an apparatus in which the protruding portion 114*d* is disposed on the left side and the toner transport path 114*a* is disposed on the right side of a central portion of the recovered toner container 114 in the Y-axis direction, if a user detaches the recovered toner container 114 from the image forming apparatus while inclining the recovered toner container 114 with respect to the Y-axis, the following problem may occur. That is, if the toner transport path 114*a* moves in the −X direction before the protruding portion 114*d* moves, the shutter 300 does not cover the dustproof windows although the toner receiving portion 114*d* has been disconnected from the toner transport path 112*a* of the cleaning device 112. Toner that has fallen from the toner receiving hole 114*d* and scattered in this state may easily adhere to the plurality of dustproof windows. Accordingly, as shown in the present embodiment, preferably, the protruding portion 114*d* and the toner transport path 114*a* are disposed on the left side of the central portion of the recovered toner container 114 in the Y-axis direction in FIG. 10(*b*).

Figure 12:
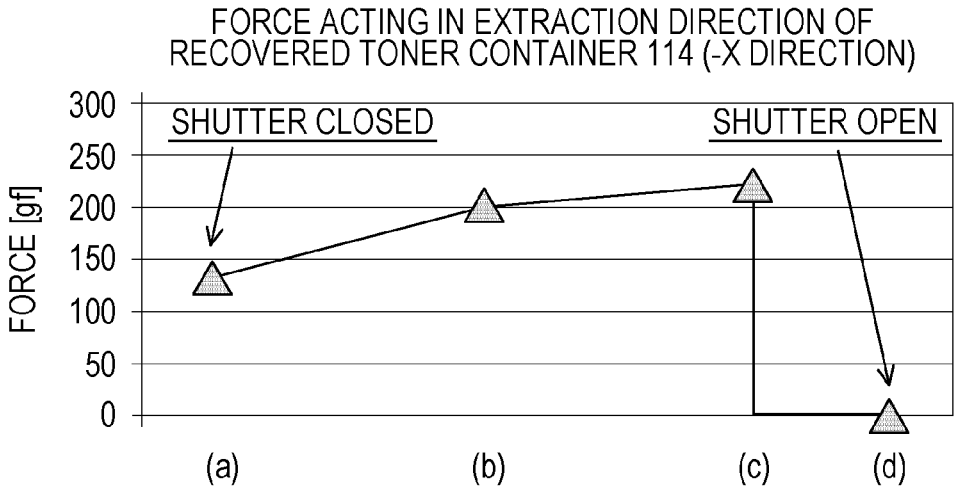
FIG. 12 illustrates an effect of a shutter moving mechanism according to a first embodiment.

FIG. 12 is a graph representing the magnitude of a force that is applied from the first arm 806 to the recovered toner container 114 in the −X direction. The symbols (a) to (d), which are arranged along the horizontal axis of FIG. 12, respectively correspond to FIGS. 11(*a*) to 11(*d*). In the state shown in FIG. 11(*a*), an elastic force generated by extension of the spring 310 urges the shutter 300, the shutter 113 applies a force Fa to the second arm 807 in the +Y direction, and the first contact portion 806*a* of the first arm 806 applies a force F'a, which corresponds to Fa, to the first flat surface 114*b*1. When the angle between the direction of F'a and the X-axis direction is defined as θb, in the state shown in FIG. 11(*a*), a force F'a×cos θa is applied to the recovered toner container 114 in the −X direction. With the structure according to the present embodiment, in the state shown in FIG. 11(*a*), a force of about 130 gf is applied to the recovered toner container 114 in the −X direction.

When a user moves the recovered toner container 114 in the +X direction from the state shown in FIG. 11(*a*), the spring 310 is extended and an elastic force of the spring 310, with which the spring 310 urges the shutter 300, is increased, and a force Fb (FIG. 11(*b*)) and a force Fc (FIG. 11(*c*)), which are larger than the force Fa, are applied from the shutter 113 to the second arm (Fa<Fb<Fc). Therefore, a force F'b corresponding to the force Fb and a force F'c corresponding to the force Fc are applied from the first contact portion 806*a* of the first arm 806 to the first flat surface 114*b*1. To the recovered toner container 114, in the state shown in FIG. 11(*b*), a force F'b×cos θb is applied in the −X direction, and, in the state shown in FIG. 11(*c*), a force F'c×cos θc is applied in the −X direction. With the structure according to the present embodiment, to the recovered toner container 114, in the state shown in FIG. 11(*b*), a force of about 200 gf is applied in the −X direction, and, in the state shown in FIG. 11(*c*), a force of about 210 gf is applied in the −X direction.

On the other hand, in the state shown in FIG. 11(*d*), because the second flat surface 114*b*2 and the movement portion 806*a* of the first arm 806 are in contact with each other, a force applied to the recovered toner container 114 in the −X direction is 0 gf. Accordingly, in FIG. 11(*d*), the recovered toner container 114 does not easily come off the toner container holding mechanism 115. It is not necessary that the second flat surface 114*b*2 be parallel to the X-axis. Preferably, the inclination angle between the X-axis and the second flat surface 114*b*2 is smaller than the inclination angle between the X-axis and the first flat surface 114*b*1. It is not necessary that the protruding portion 114*b* have only two flat surfaces, such as the first flat surface 114*b*1 and the second flat surface 114*b*2. Alternatively, the protruding portion 114*b* may have three or more flat surfaces. The shape of the protruding portion 114*b* may be a curved surface having an inclination angle that becomes smaller in the −X direction. The second flat surface 114*b*2 may have a shape such that the second flat surface 114*b*2 is in line contact with or in point contact with the movement portion 806*a*. In other words, it is only necessary that a reactional force applied from the second flat surface 114*b*2 to the movement portion 806*a* (along a line or at a point) is oriented in the Y-axis direction.

Figure 13:
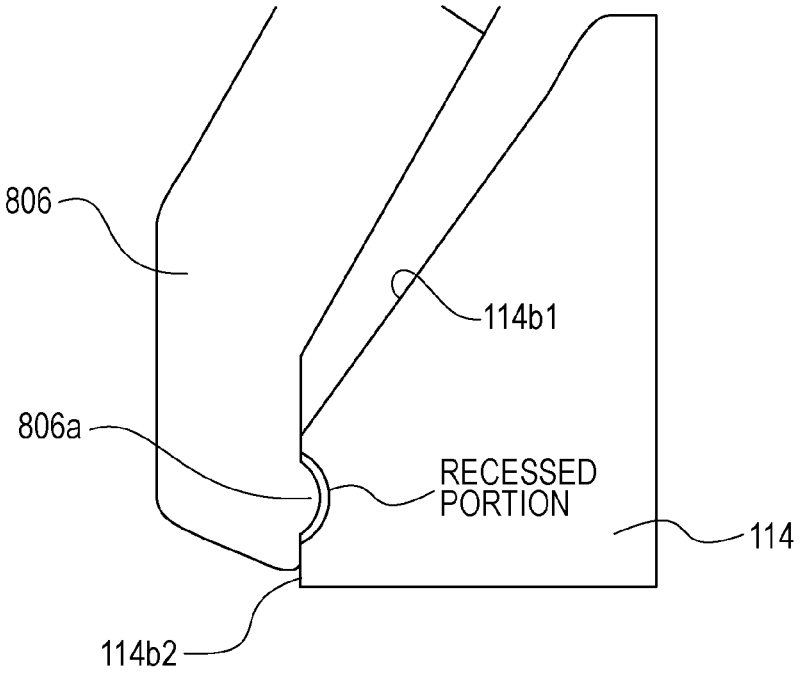
FIG. 13 illustrates a modification of a distal end of the protruding portion.

FIG. 13 illustrates an embodiment in which the second flat surface 114*b*2 includes a spherical recessed portion and the first movement portion 806*a* of the first arm 806 includes a spherical protruding portion that engages with the recessed portion. By providing an engagement mechanism illustrated in FIG. 13, the recovered toner container 114 can be made more unlikely to come off the toner container holding mechanism 115.

In the present embodiment, the protruding portion 114*b* is formed on the recovered toner container 114. However, this is not a limitation on the embodiment. For example, a protruding portion corresponding to the protruding portion 114*b* may be formed on the door 113 illustrated in FIG. 2, so that the shutter 300 can be opened by closing the door 113 and can be closed by opening the door 113.

As heretofore described, the shutter moving mechanism according to the present embodiment includes the rotation mechanism 803, and the rotation mechanism 803 moves the shutter 300 in accordance with movement of the recovered toner container 114, which contacts the rotation mechanism. Therefore, the shutter 300 can be moved by using a simple structure without using a sensor or a motor. Moreover, a force with which a user urges the recovered toner container 114 toward the image forming apparatus when replacing the recovered toner container 114 can be reduced. The shutter moving mechanism according to the present embodiment includes the rotation mechanism 803, and the rotation mechanism 803 moves the shutter 300 in accordance with movement of the door 113, which contacts the rotation mechanism 803. Therefore, the shutter 300 can be moved by using a simple structure without using a sensor or a motor. Moreover, a force with which a user urges the door 113 toward the image forming apparatus when closing the door 113 can be reduced.

The present invention is not limited to the embodiment described above and can be changed or modified in various ways within the sprit and scope of the present invention. Accordingly, the following claims are attached to disclose the scope of the present invention.

The present application is based on and claims priority from Japanese Patent Application No. 2012-285799 filed Dec. 27, 2012, the entire contents of which are incorporated herein.

REFERENCE SIGNS LIST

218 cover
218*c*, 218*d* protruding portion
218*e* engagement portion
302, 303 elongated hole
300 shutter
310 spring
803 rotation mechanism

The invention claimed is:

1. An image forming apparatus comprising:

a plurality of photoconductors and a plurality of developing devices corresponding to each of the photoconductors and configured to develop electrostatic latent images, which are formed on the plurality of photoconductors, by using toner;

an optical scanning device disposed below the plurality of photoconductors and the plurality of developing devices in a direction of gravity and including transparent windows, wherein each of the transparent windows allows a passage of a light beam which corresponds to one of the plurality of photoconductors and forms the electrostatic latent images on the one of the plurality of photoconductors;

a shutter provided with a plurality of portions each of which allows a passage of a light beam having passed through one of the plurality of transparent windows, disposed between the plurality of photoconductor members and the optical scanning device, and configured to slide between a first position and a second position which is different from the first position in a transversal direction with respect to a scanning direction of the light beams, wherein the light beams pass through the plurality of portions of the shutter at the first position and the shutter at the second position covers the transparent windows;

a transfer device including an intermediate transfer member to which toner images on the photoconductor members are transferred and configured to transfer the toner images on the intermediate transfer member to a recording medium;

a cleaning device configured to recover residual toner that is not transferred to the recording medium and remains on the intermediate transfer member;

a toner container holding unit configured to hold a toner container for containing the residual toner recovered by the cleaning device, the toner container being attachable to and detachable from a body of the image forming apparatus and including a protruding portion; and a shutter moving mechanism including a first movement portion that moves around a rotation shaft as a rotation axis and a second movement portion that contacts the shutter and that moves around the rotation shaft as the rotation axis in accordance with movement of the first movement portion around the rotation shaft, wherein, in a process for attaching the toner container to the toner container holding unit, the first movement portion contacts the protruding portion of the toner container before the toner container is held by the toner container holding unit, the first movement portion pressed by the protruding portion and the second movement portion move around the rotation shaft and the second movement portion presses the shutter in accordance with movement of the toner container toward the toner container holding unit, and thereby the shutter slides from the second position to the first position.

2. The image forming apparatus according to claim 1, wherein the shutter moving mechanism includes a spring that is connected to the shutter and to the optical scanning device so that an elastic force of the spring increases as the shutter slides from the first position toward the second position, and wherein, in accordance with movement of the toner container in a process for detaching the toner container from the toner container holding unit, the shutter slides from the first position to the second position by the elastic force of the spring, and wherein the first movement portion and the second movement portion move around the rotation shaft in a first direction in the process for attaching the toner container, and the first movement portion and the second movement portion move around the rotation shaft in a second direction that is opposite to the first direction in the process for detaching the toner container.

3. The image forming apparatus according to claim 2, wherein the shutter moving mechanism includes a rotation mechanism including a rotary portion that rotates around the rotation shaft as the rotation axis, a first arm including the first movement portion and extending from the rotary portion, and a second arm including the second movement portion and extending from the rotary portion, wherein, in the process for attaching the toner container, the first arm moves around the rotation shaft as the rotation axis in the first direction in accordance with movement of the toner container, the rotary portion rotates around the rotation shaft as the rotation axis in the first direction due to movement of the first arm in the first direction, and the second arm moves around the rotation shaft as the rotation axis in the first direction due to rotation of the rotary portion in the first direction, and wherein, in the process for detaching the toner container, the first arm moves in the second direction in accordance with movement of the toner container, the rotary portion rotates around the rotation shaft as the rotation axis in the second direction due to the movement of the first arm around the rotation shaft as the rotation axis in the second direction, and the second arm moves in the second direction due to rotation of the rotary portion in the second direction, wherein the shutter slides from the second position to the first position by the second movement portion of the second arm moving in the first direction pressing the shutter and slides from the first position to the second position by the elastic force of the spring when the second arm moves in the second direction.

4. The image forming apparatus according to claim 1, wherein the plurality of photoconductor members are photoconductor drums, and the photoconductor drums are attached to or detached from the image forming apparatus by being moved in a direction of rotation axes of the photoconductor drums, wherein the cleaning device recovers residual toner on the plurality of photoconductor drums and transports the residual toner to the toner container, and wherein each of the plurality of photoconductor drums becomes attachable to and detachable from the image forming apparatus in a state in which the toner container is detached from the toner container holding unit.

5. The image forming apparatus according to claim 1, wherein the plurality of photoconductor members are photoconductor drums, and the plurality of developing devices are attached to or detached from the image forming apparatus by being moved in a direction of rotation axes of the photoconductor drums, wherein the cleaning device recovers residual toner on the plurality of photoconductor drums and transports the residual toner to the toner container, and wherein each of the plurality of developing devices becomes attachable to and detachable from the image forming apparatus in a state in which the toner container is detached from the toner container holding unit.

6. The image forming apparatus according to claim 1, wherein the protruding portion includes a protruding portion including a first contact surface that contacts the first movement portion and that is inclined with respect to an imaginary plane that is parallel to a direction in which the toner container moves in the process for attaching the toner container or in the process for detaching the toner container and a second contact surface that contacts the first movement portion, that is continuous with the first contact surface, and that has an inclination angle with respect to the imaginary plane smaller than that of the first contact surface, and wherein, in the process for attaching the toner container, the first movement portion contacts the first contact surface, moves along the first contact surface toward the second contact surface from a state in which the first movement portion is in contact with the first contact surface in accordance with movement of the toner container, and contacts the second contact surface in a state in which the toner container is held by the toner container holding unit.

7. The image forming apparatus according to claim 6, wherein the imaginary plane is parallel to the second contact surface.

8. The image forming apparatus according to claim 6, wherein the first movement portion includes an engagement portion that engages with an engagement portion of the second contact surface in a state in which the toner container holding unit holds the toner container.

9. The image forming apparatus according to claim 8, wherein the first movement portion includes an engagement portion that engages with an engagement portion of the second contact surface in a state in which the toner container holding unit holds the toner container.

10. The image forming apparatus according to claim 1, wherein the plurality of photoconductor members are photoconductor drums, the toner container holding unit holds the toner container so that at least a part of the toner container overlaps the cleaning device in a direction of rotation axes of the photoconductor drum.

11. The image forming apparatus according to claim 1, comprising:

a cartridge holding unit for holding a plurality of cartridges including the photoconductor members, the developing devices, and the cleaning device, the plurality of cartridges being attachable to and detachable from the body of the image forming apparatus, wherein the toner container includes a receiving hole for receiving the residual toner from a cleaning device of each of the plurality of cartridges held by the cartridge holding unit, a containing portion for storing the residual toner received through the receiving hole, and a contact portion that contacts the first movement portion.

12. The image forming apparatus according to according to claim 11, wherein the receiving hole is provided in a plurality so as to correspond to the cleaning devices of the plurality of cartridges.

13. The image forming apparatus according to claim 11, comprising:

a plurality of guide members that restrict directions in which the plurality of cartridges are detached when the cartridges are attached to and detached from the image forming apparatus, wherein the toner container holding unit holds the toner container on extension lines of the guide members.

14. An image forming apparatus comprising:

an image forming unit comprising:

a plurality of photoconductors and a plurality of developing devices corresponding to each of the photoconductors and configured to develop electrostatic latent images, which are formed on the plurality of photoconductors by using toner;

an optical scanning device disposed below the plurality of photoconductors and a plurality of developing devices in a direction of gravity and including transparent windows, wherein each of the transparent windows allows a passage of a light beam which corresponds to one of the plurality of photoconductors and forms the electrostatic latent images on the one of the plurality of photoconductors;

a transfer device configured to transfer the toner images on the intermediate transfer member to a recording medium;

a shutter provided with a plurality of portions each of which allows a passage of a light beam having passed through one of the plurality of transparent windows, disposed between the plurality of photoconductor members and the optical scanning device, and configured to slide between a first position and a second position which is different from the first position in a transversal direction with respect to a scanning direction of the light beams, wherein the light beams pass through the plurality of portions of the shutter at the first position and the shutter at the second position covers the transparent windows;

a body configured to contain the image forming unit, a cleaning device, and a toner container holding unit, and including a door having a protruding portion and that is opened and closed to maintain the image forming unit; and a shutter moving mechanism including a first movement portion that moves around a rotation shaft as a rotation axis and a second movement portion that contacts the shutter and that moves around the rotation shaft as the rotation axis in accordance with movement of the first movement portion around the rotation shaft, wherein, in a process that the door is closed, the first movement portion contacts the protruding portion before the door is closed completely, the first movement portion pressed by the protruding portion and the second movement portion moves around the rotation shaft and the second movement portion presses the shutter in accordance with movement of the door toward a complete closed position of the door, and thereby the shutter slides from the second position to the first position.

15. The image forming apparatus according to claim 14, further comprising:

a cleaning device configured to recover residual toner, that is not transferred to the recording medium, from the image forming unit;

a toner container holding unit configured to hold a toner container for containing the residual toner recovered by the cleaning device, the toner container being attachable to and detachable from a body of the image forming apparatus;

wherein the door is opened and closed to replace a toner container held by the toner container holding unit.

16. The image forming apparatus according to claim 15, wherein the plurality of photoconductor members are photoconductor drums, and the photoconductor drums are attached to or detached from the image forming apparatus by being moved in a direction of rotation axes of the photoconductor drums, wherein the cleaning device recovers residual toner on the plurality of photoconductor drums and transports the residual toner to the toner container, and wherein each of the plurality of photoconductor drums becomes attachable to and detachable from the image forming apparatus in a state in which the toner container is detached from the toner container holding unit.

17. The image forming apparatus according to claim 14, wherein the shutter moving mechanism includes a spring that is connected to the shutter and to the optical scanning device so that an elastic force of the spring increases as the shutter slides from the first position to the second position, and wherein, in accordance with movement of the door in a process that the door is opened, the shutter slides from the first position to the second position by the elastic force of the spring, and wherein the first movement portion and the second movement portion move around the rotation shaft in a first direction in the process that the door is closed, and the first movement portion and the second movement portion move around the rotation shaft in a second direction that is opposite to the first direction in the process that the door is opened.

18. The image forming apparatus according to claim 17, wherein the shutter moving mechanism includes a rotation mechanism including a rotary portion that rotates around the rotation shaft as the rotation axis, a first arm including the first movement portion and extending from the rotary portion, and a second arm including the second movement portion and extending from the rotary portion, wherein, in the process that the door is closed, the first arm moves around the rotation shaft as the rotation axis in the first direction in accordance with movement of the door, the rotary portion rotates around the rotation shaft as the rotation axis in the first direction due to movement of the first arm in the first direction, and the second arm moves around the rotation shaft as the rotation axis in the first direction due to rotation of the rotary portion in the first direction, and wherein, in the process that the door is opened, the first arm moves in the second direction in accordance with movement of the door, the rotary portion rotates around the rotation shaft as the rotation axis in the second direction due to the movement of the first arm around the rotation shaft as the rotation axis in the second direction, and the second arm moves in the second direction due to rotation of the rotary portion in the second direction, and wherein the shutter slides from the second position to the first position by the second movement portion of the second arm moving in the first direction pressing the shutter and slides from the first position to the second position by the elastic force of the spring when the second arm moves in the second direction.

* * * * *